United States Patent [19]

Westerlund et al.

[11] Patent Number: 4,533,300

[45] Date of Patent: Aug. 6, 1985

[54] HIGH PRESSURE PUMPING APPARATUS FOR SEMI-FLUID MATERIAL

[75] Inventors: Robert E. Westerlund, 10409 N. Westview 41W, Mequon, Wis. 53092; Wayne L. Read, West Bend, Wis.

[73] Assignee: Robert E. Westerlund, Mequon, Wis.

[21] Appl. No.: 620,898

[22] Filed: Jun. 15, 1984

Related U.S. Application Data

[63] Continuation of Ser. No. 366,596, Apr. 8, 1982, abandoned, which is a continuation of Ser. No. 112,420, Jan. 12, 1980, abandoned, which is a continuation-in-part of Ser. No. 47,301, Jun. 11, 1979, Pat. No. 4,345,883.

[51] Int. Cl.[3] ..... F04B 15/02

[52] U.S. Cl. ..... 417/339; 417/517; 417/900

[58] Field of Search ..... 417/339, 516, 517, 518, 417/519, 532, 900

[56] References Cited

U.S. PATENT DOCUMENTS

| | | | |
|---|---|---|---|
| 2,033,338 | 3/1936 | Kirby | 417/317 |
| 2,442,916 | 6/1948 | Buchanan | 417/393 X |
| 3,298,322 | 1/1967 | Sherrod | 417/900 X |

FOREIGN PATENT DOCUMENTS

| | | | |
|---|---|---|---|
| 972621 | 8/1975 | Canada | 417/900 |

*Primary Examiner*—Richard E. Gluck

*Attorney, Agent, or Firm*—Andrus, Sceales, Starke & Sawall

[57] ABSTRACT

Concrete is transmitted from a hopper forming a part of a mobile concrete pumping apparatus to the deposit site through a flow line having a Y-pipe inlet. The pumping apparatus includes two piston-cylinder concrete pumps mounted in side-by-side relationship adjacent the hopper, which has an auger to rapidly charge a pump with concrete through one of two discharge pipes. Each pump is pivotally mounted, to locate the cylinder aligned with the discharge pipe or with one inlet of the Y-pipe inlet. Each pump has a valve plate pivoting with the cylinder to alternately close the hopper opening and the inlet line. Hydraulic cylinder units are coupled to the valve plates to pivot the pumps. A floating valve plate has coupling pipes attached to the hopper and a hydraulic cylinder urges the same into sliding sealing engagement with the rotating valve plate. The pumps are individually, alternately and oppositely positioned for charging and discharging, with a common discharge period at the end of the one pump unit and start of the other pump unit.

9 Claims, 15 Drawing Figures

Fig. 1
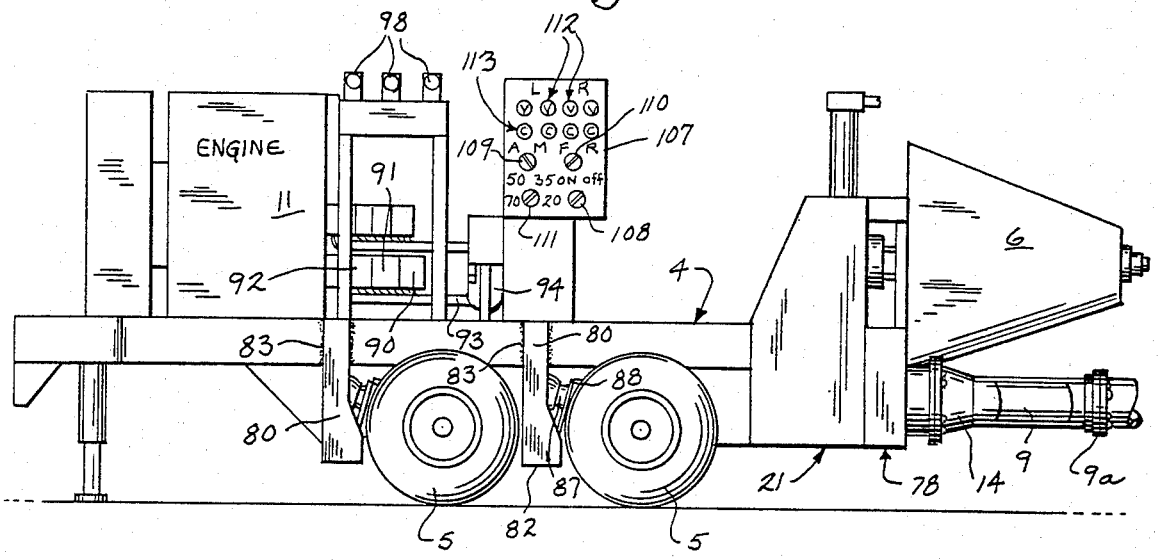
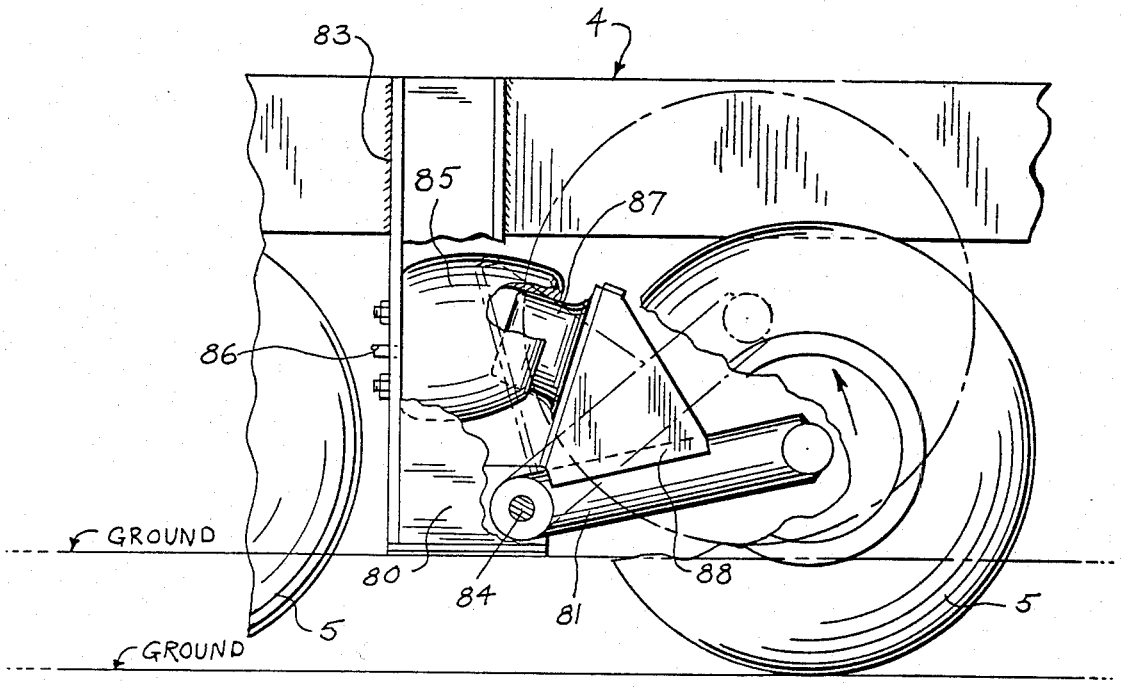
Fig. 2

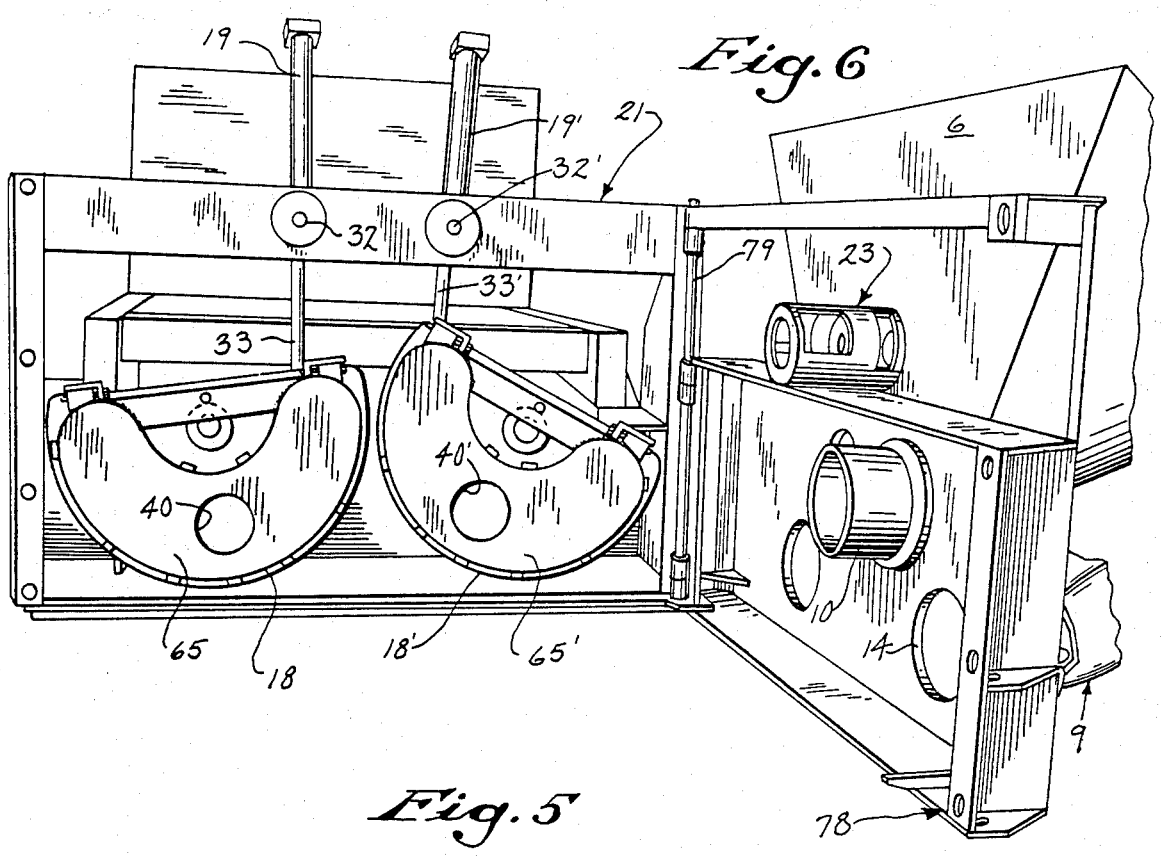
Fig. 6
Fig. 5
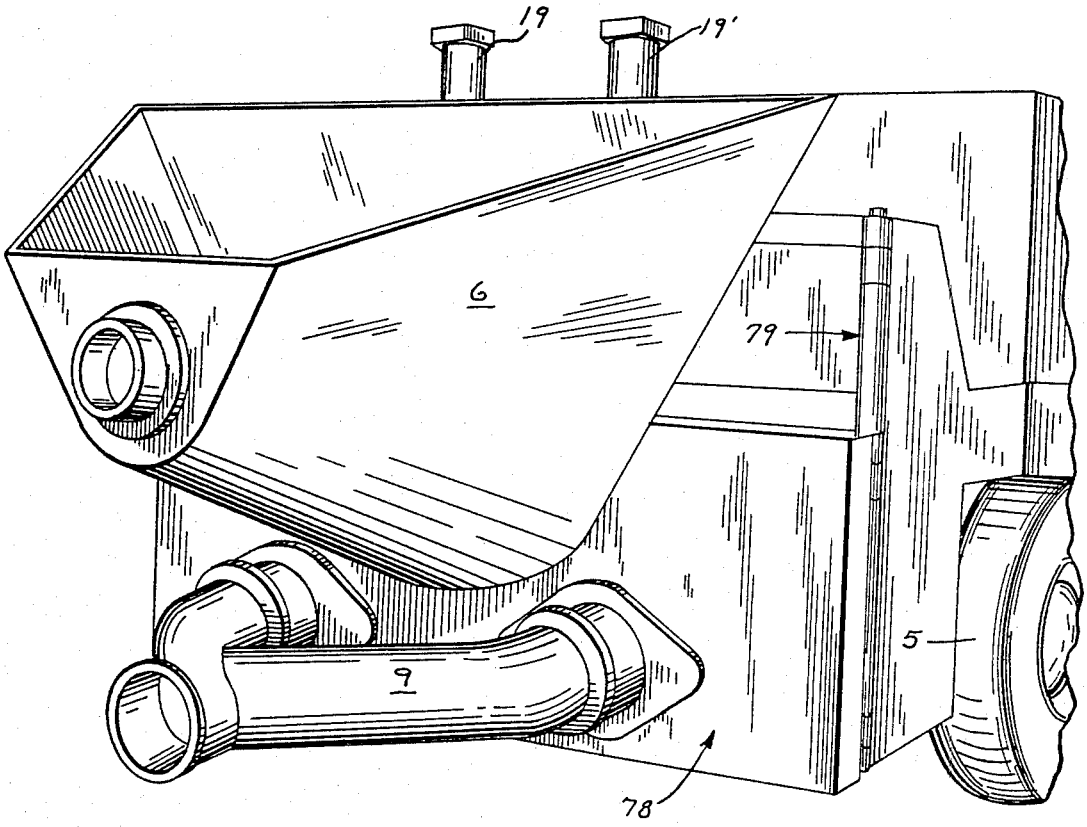

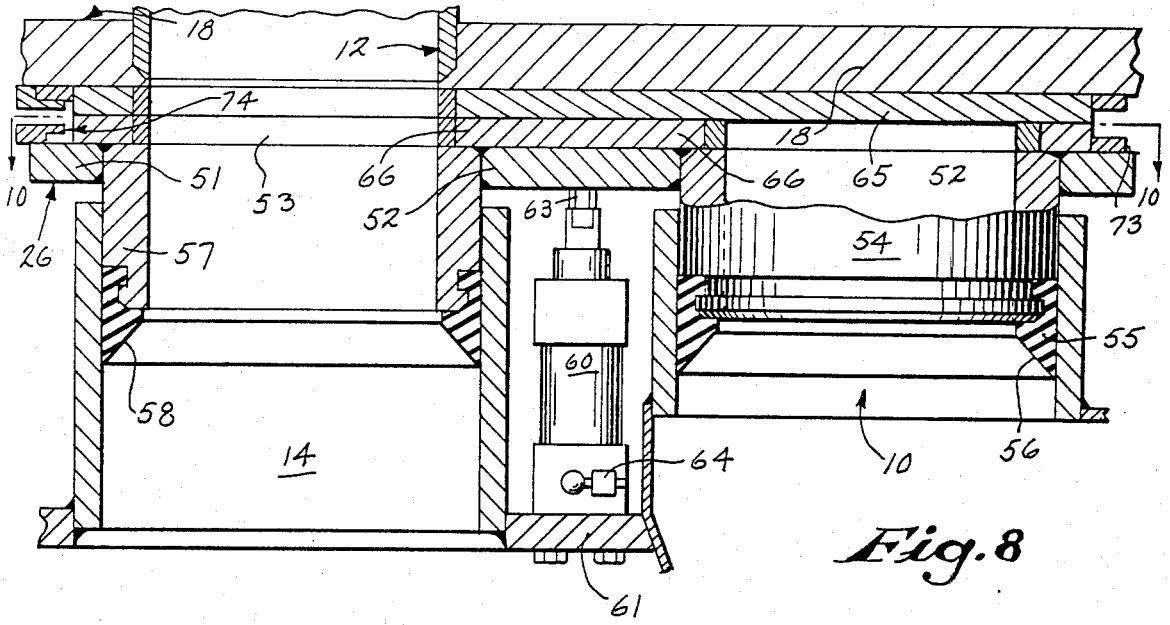
Fig. 8
Fig. 7
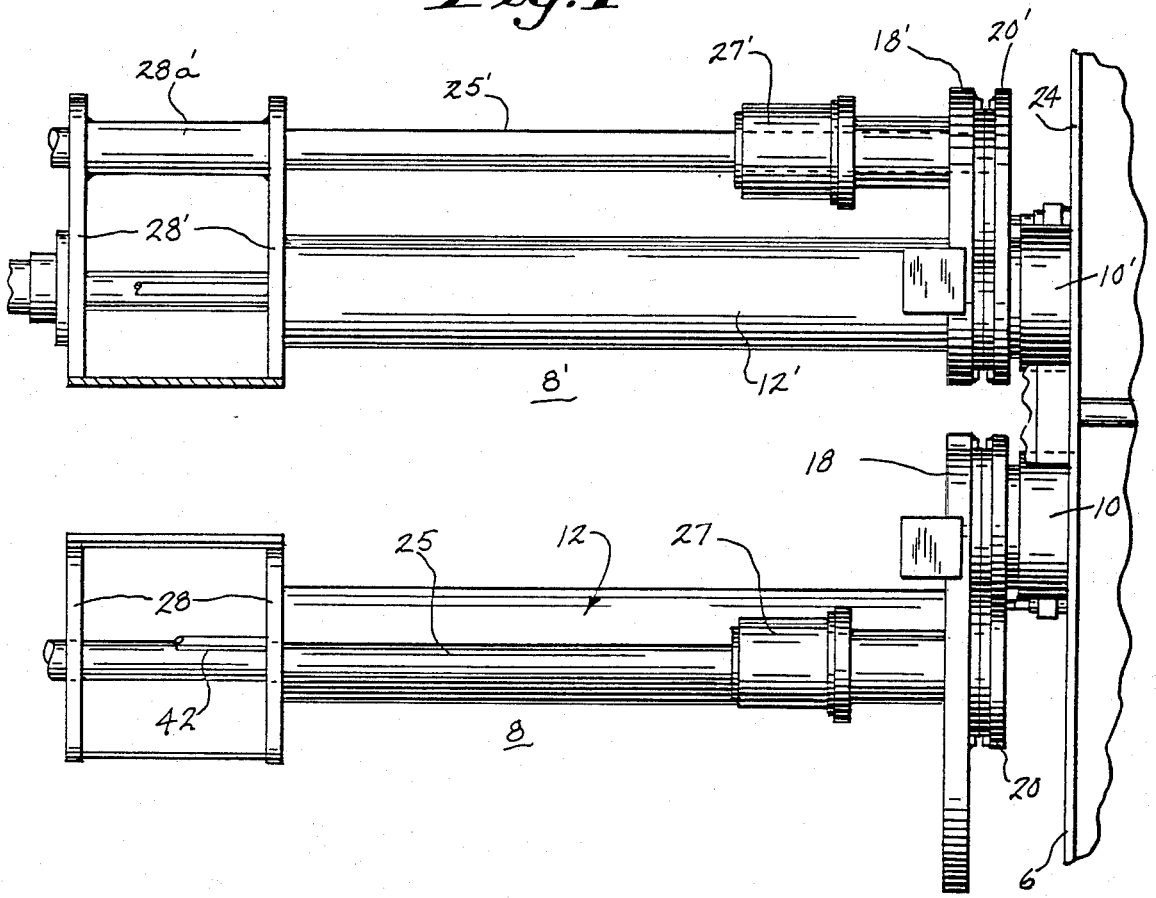

HIGH PRESSURE PUMPING APPARATUS FOR SEMI-FLUID MATERIAL

This application is a continuation of application Ser. No. 366,596, filed Apr. 8, 1982, now abandoned, which is a continuation of Ser. No. 112,420, filed Jan. 12, 1980, now abandoned, which is a continuation-in-part of Ser. No. 47,301, filed June 11, 1979, now U.S. Pat. No. 4,345,883.

BACKGROUND OF THE INVENTION

The present invention relates to high pressure concrete pumping apparatus and particularly to such pumping apparatus for transmitting of semi-fluid products such as concrete over relatively long distances.

Cement, concrete, plaster and similar building materials are advantageously transmitted through suitable flow lines from a central source, such as a mixing station or dump site to the deposit location. For example, in bridges, tall buildings and other structures, the transport of the material in batches was the normal method of carrying the materials for many years. However, concrete pumping apparatus has been developed which permits more or less continuous delivery of such material through a flow system constructed at the site. In many applications, relative long pumping lines are required for carrying the concrete from a central location to the deposit site. Further, the flow path may includes substantial vertical rising portions. For example, in the construction of cooling towers for nuclear power stations, the concrete has been historically raised through the use of buckets carried by suitable elevating means such as temporarily installed elevators, cranes and the like. In addition to being time consuming, such batch systems may create dangerous environments. Thus, if a concrete-filled bucket at the end of a crane inadvertently swings and strikes the structure, severe damage can result to both the property and the workmen. The pumping of concrete substantially eliminates such problems. Concrete pumping systems generally include positive displacement pumps to produce flow through the lines and various means have been suggested to create constant movement and delivery. Generally, multiple pumping arrangements have been suggested with alternate pump operation, and in some instances overlapping operation, provided in an attempt to develop essentially constant delivery of the pump material. Different systems use mechanical interlocks to effectively transfer the motion between the several pump units. Alternatively, various valving and interlocking flow mechanisms are used in the attempt to maintain the constant flow.

Generally, the prior art pump units involve some slight delay during the pumping cycles in which the pumping force decreases or drops sufficiently to permit effective stopping of the flow through the system. When the outward pumping action is again initiated, even though only a momentary delay is involved, substantial and significant inertia and friction forces within the system must be overcome.

The flow characteristics of the concrete or other similar semi-fluid material thus establish significant loads on the pumping system and may result in a complete failure of flow, with a resulting down time as well as relatively costly system clean-out required.

Another very significant factor which arises from the usual flow characteristic is the pulsating or recoil forces on the flow lines. The varying forces in flow cause movement of the flow line. Under certain conditions, the flow line movement is often sufficiently great as to create a hazardous condition. For example, with the flow line attached to a structure for carrying of concrete to the upper or top portion, the line movement may shake the building. For example, shaking of previously set concrete may result in a force which breaks the bond between the concrete and the reinforcing rods, with resulting weakening of the structure. With present systems, the elbows of the flow line system are embedded in relatively massive reaction blocks to minimize line movement. Such a system for example is disclosed in an article at page 379 of Concrete Construction magazine of June, 1979. As more fully described therein, a coupling elbows is advantageously embedded in a reaction block formed of more than one yard of concrete. Thus, an 8,000 lbs. concrete reaction block serves to firmly support and stabilize the flow line, minimizing the movement of the line and thereby shaking of the interconnected elements. In other applications, one or two men may be placed on the flow line to steady and support the line during the pumping operation. Even with two men, the pulsating effect may be so great as to create a force capable of knocking the men over. Further, the flow line must often be repositioned, at least at the upper end for most advantageous depositing of the concrete. It is therefore desirable to have a line system which can be crane mounted. Obviously with the highly pulsating effect associated with many conventional systems, crane mounting is difficult if not impossible unless very special crane constructions and supports are supplied.

In summary, the pulsating effect associated with the conventional prior art flow systems not only create problems within the pumping system but create very significant problems in connection with the associate components and personnel, all which have required rather special consideration and expense.

Further mechanical devices inherently are subject to wear, particularly in the environment of harsh materials such as concrete. Thus, even though the devices might operate satisfactorily when first constructed if sufficient attention has been given thereto, the components may rapidly lose the original characteristic. A lack of a significant operating life will of course prevent practical implementation of a design.

Thus, although the concrete pumping apparatus provides improved movement of concrete over the conventional bucket system and such apparatus is widely used in building and rod constructions, concrete pumping apparatus is not presently available which is particularly satisfacory for job application in which relatively long distances or significant vertical heights are encountered.

SUMMARY OF THE INVENTION

The present invention is particularly directed to positive displacement semi-fluid pumping means including a plurality of pumping units with completely separate but interrelated driving controls to develop appropriate timed operation of the controls and pumping units such that overlapped operation of the individual pumping units establishes and maintains a constant outward flow of semi-fluid material through the system over the total operating period. The present invention permits the pumping of highly abrasive and semi-fluid materials such as plaster, cement and particularly concrete over long distances as well as short distances. The invention is therefore described hereinafter with reference to pumping concrete. Generally, in accordance with the teaching of the present invention, each pumping unit is connected to a positioning and driving means. The pumping units are movably mounted for selective coupling between a concrete source and an input to a transfer flow system. Each pumping unit is individually charged and discharged. The units, however, are constructed such that each is moved to a discharge position during the terminal discharging portion of the alternating unit and actuated to initiate a discharge before complete discharge of the first unit. Thus, there is a slight overlapping period when both units are discharging. At the end of such overlapping, the completely discharged unit is transferred or moved to a charging position, and separately and independently charged at a rate significantly greater than the discharging period such that it is charged prior to the complete discharge of the then discharging unit. The newly charged pumping unit is then moved into the discharge position and discharge thereof initiated just prior to the final discharge of the then discharging unit. The charging and discharging of the pumping units is separately and independently controlled as far as the pumping units are concerned. The overlapping time of operation is controlled within the controlled unit to permit accurate controlling thereof. This individual positioning and operation of the pumping units permits use of a simple and reliable valve means and accurate selective coupling of the pump units to the transfer flow system.

Although other forms and embodiments of the invention may include the above features of this invention, a preferred and particularly unique embodiment of the present invention includes a pair of pumping means such as pair of piston-cylinder pumping units and individual hydraulic piston-cylinder driving units. The pair of pumping units are mounted in side-by-side relationship to a power feed concrete supply unit. The pumping units and a hydraulical supply system are mounted on a support, which is preferably a mobile chassis for transport of the assembly. The concrete supply unit is pivotally attached to the chassis for swinging of the supply unit into operative coupling to the pair of pumping units. The source may, for example be a common hopper having an auger drive for forcing of the concrete to a pair of appropriate side-by-side located hopper discharge openings. Each of the pumping units is pivotally mounted, with the pumping cylinder pivoted between a discharge opening of the hopper unit and a laterally located input line of the outlet flow system. The individual input lines merge into a common flow line for transmission of the concrete to the deposit site. Each pumping unit includes an integrated swinging or rotating valve plate assembly which pivots with the pumping cylinder and moves selectively into overlying relationship to the hopper opening and the siamese inlet line. Individual hydraulic cylinder positioning units are provided and coupled to the rotating valve assemblies to selectively position the pumping means and particularly the pumping cylinders for charging and discharging. The hydraulic cylinder units are coupled to a suitable hydraulic power supply and control for establishing proper timed rotation of the valve plate assemblies and interconnected cylinders. The hydraulic power supply, in one feature which may be provided, includes valve means to control the rate of flow of hydraulic fluid for accurately adjusting the timing of the movement of the cylinder units. A floating valve plate assembly includes a telescoping coupling conduit means projecting into the hopper opening and into the siamese input line. The floating valve plate assembly is mounted for limited floating movement and a pressure means is provided for continuously urging the floating valve plate assembly into sliding engagement with the rotating valve plate assembly. The rotating valve plate assembly, and floating plate assembly, may be also formed as a unique assembly including a base support plate integrally connected to the pumping cylinder and to which the positioning unit is connected for pivoting of the assembly. A wear plate is releasably clamped to the support plate with an adjustment means permitting the accurate alignment of the wear plate openings with the pumping cylinder. In a particular embodiment, a hydraulic cylinder means is also connected to the floating valve plate and continuously forces the floating valve plate into engagement with the rotating valve plate assembly and particularly the replaceable wear plate. An auxiliary resilient seal ring may be provided about one wear plate. The pumping cylinders are alternatively coupled to the hopper for charging and to its corresponding system inlet line for discharge of the concrete.

As noted above, the preferred embodiment includes a movile chassis with the hopper mounted to one end by a suitable swinging support. The hydraulic equipment is mounted to the opposite end of the chassis to distribute the weight and provide a balanced load for ease of transport and on-site stability.

Additionally, the supporting wheels for the mobile unit are preferably constructed with pivoting axle arms which pivot on a transverse axis. The wheels are thereby mounted for swinging of the wheels down into a transport position and upwardly to lower rigid, stable support legs onto the ground during a pumping operation. A wheel positioning power means preferably includes a sealed pneumatic air bag secured to the support legs and a piston projecting into the bag as a rolling diaphragm and secured to the axle arms.

The system can be provided with any type of automatic sensing and operating control. For example, suitable limit switches can readily be provided on the output of hydraulic cylinder unit of the pump units to provide position related signals for the related concrete pump. These signals may be applied to the control system which in turn provides for proper connection of the hydraulic supply to pumping and the positioning cylinders. Further, the hydraulic flow system is preferably constructed with flow rate control valves to vary the interrelated speed of the several units to adjust the concrete pumping rate as required for a given installation.

The present invention provides a reliable means of maintaining proper and complete synchronous movement of the pump units for establishing and maintaining a constant flow characteristic.

The present invention particularly provides a reliable and highly effective concrete pumping apparatus for maintaining a constant flow of concrete through the transfer flow system.

BRIEF DESCRIPTION OF THE DRAWINGS

The drawings furnished herewith illustrate a preferred construction of the present invention in which the above advantages and features are clearly disclosed as well as others which will be readily understood from the following description.

In the drawings:

FIG. 1 is a side elevational view of a concrete pumping apparatus constructed in accordance with the present invention;

FIG. 2 is an enlarged fragmentary view illustrating the wheel support for the mobile unit shown in FIG. 1;

FIG. 5 is a pictorial view of a concrete hopper UNIT SHOWN IN FIGS. 1-4;

FIG. 6 is a view similar to FIG. 5 showing the hopper unit swung open for access to internal components;

FIG. 7 is an enlarged fragmentary top view taken generally on line 7—7 of FIG. 3;

FIG. 8 is an enlarged sectional view taken generally on line 8—8 of FIG. 9;

DESCRIPTION OF THE ILLUSTRATED EMBODIMENT

Figure 3:
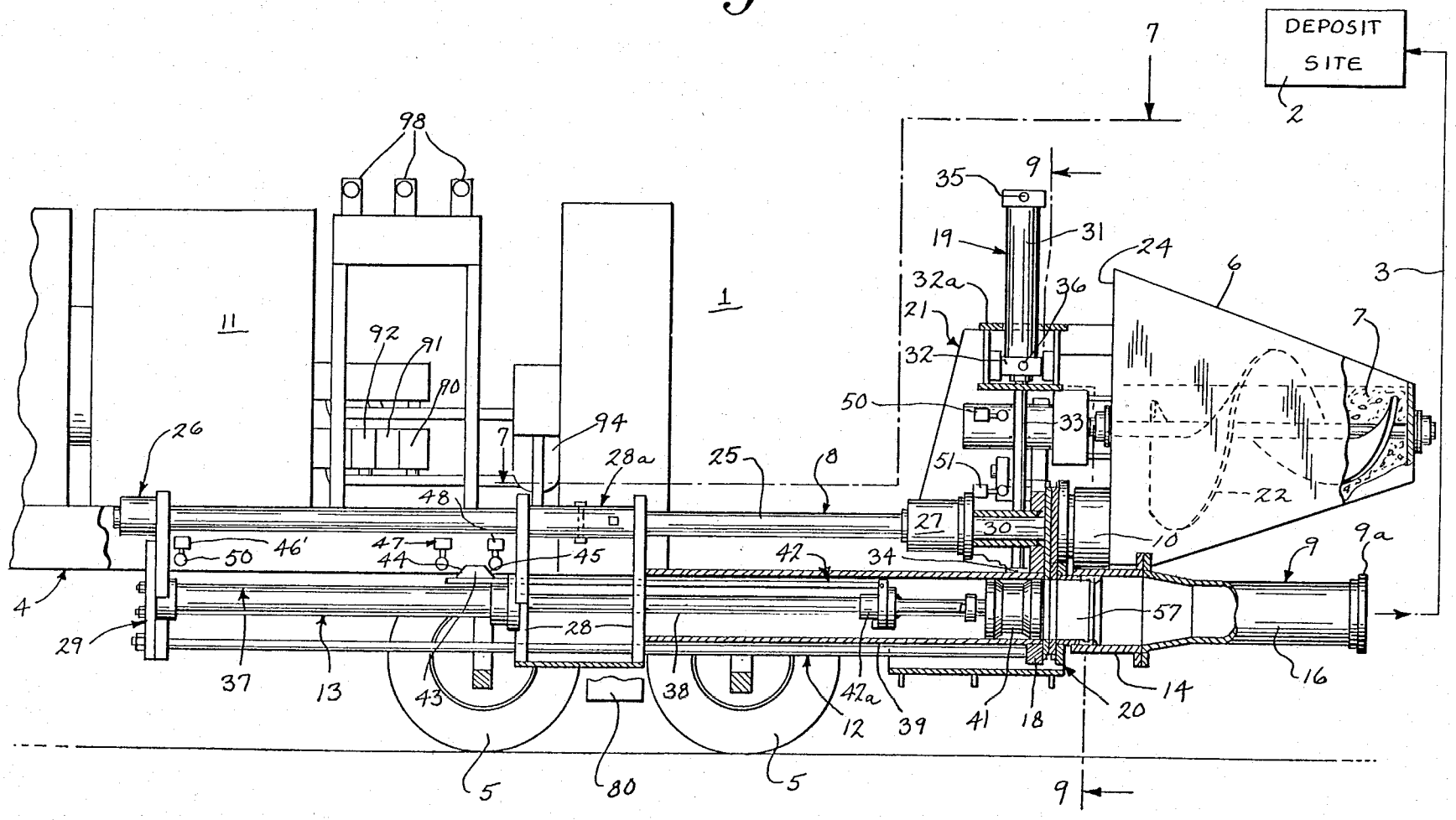
FIG. 3 is an enlarged side elevational view with parts broken away and sectioned to show details of construction.

Referring to the drawings and particularly to FIGS. 1, 2 and 3, a mobile concrete pumping apparatus 1, illustrating a preferred embodiment of the present invention, is shown. In FIG. 3, the apparatus is diagrammatically illustrated connected to a remote deposit site 2 by an interconnecting flow line 3. The illustrated pumping apparatus is a mobile assembly including a supporting chassis or framework 4 provided with suitable support wheels 5. The support wheels 5 are mounted for vertical movement, to establish a mobile support as in FIG. 1 and a stable pumping support as in FIG. 3. As the support structure can be of any suitable or desired construction which can be readily provided by those skilled in the art, the support is not shown in detail and is described herein as necessary to set forth particular features of the preferred construction.

Figures 4, 10:
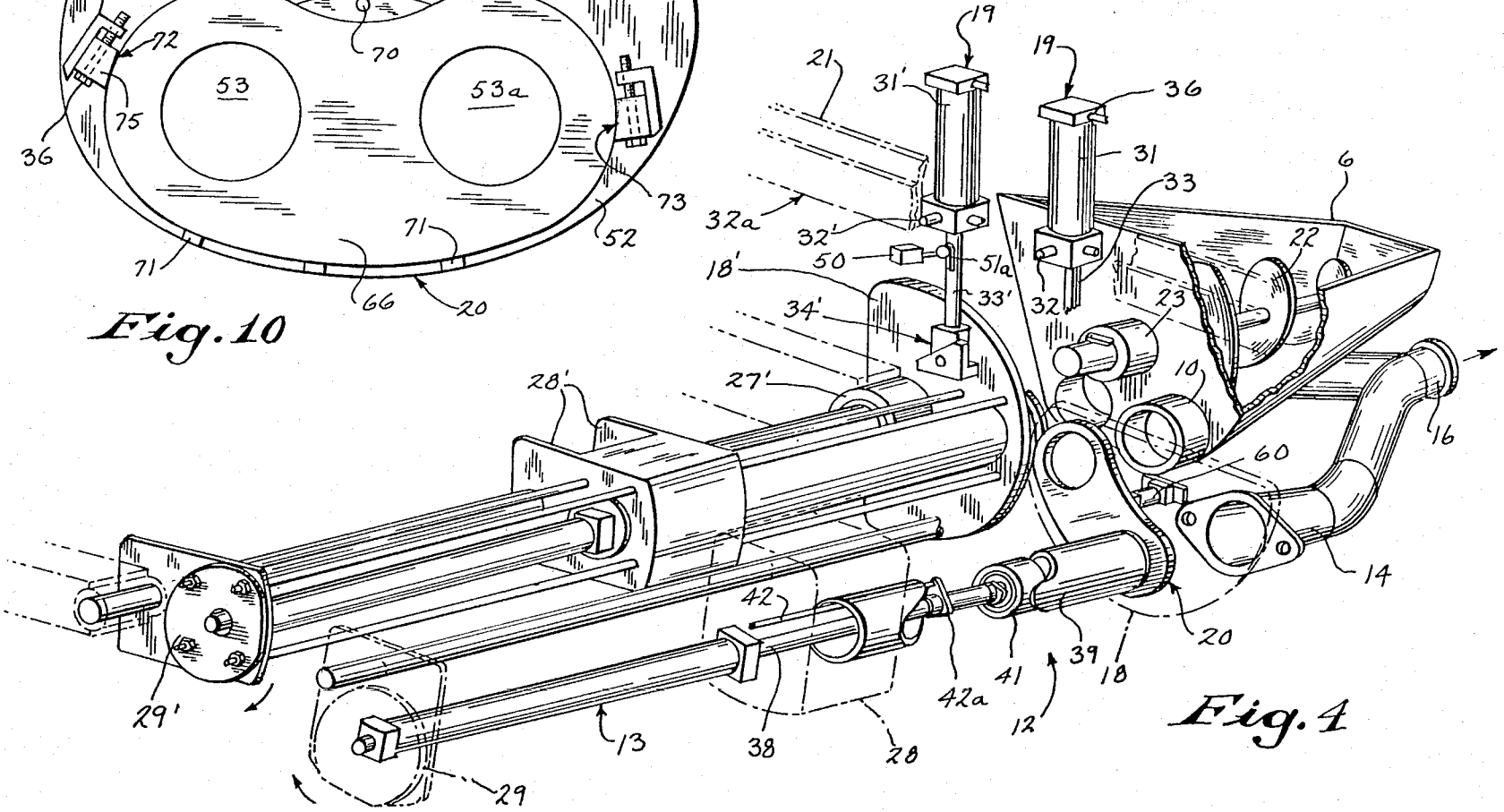
FIG. 4 is a pictorial view of portions of the pumping apparatus shown in FIGS. 1 and 3.
FIG. 10 is a fragmentary view taken generally on line 10—10 of FIG. 8.

A concrete hopper 6 is mounted to the end of the frame, hereinafter referred to as the back end, within which semi-fluid concrete 7 is held as a continuous source or supply. Thus, concrete 7 is poured into the hopper through an opened top from any source, such as is conventionally used in the trade. Referring to FIGS. 3 and 4, the embodiment of the present invention shown includes first and second concrete pump assemblies 8 and 8′ mounted immediately forwardly of and coupled to hopper 6. Pump assemblies 8 and 8′ are operable to remove the concrete 7 and deliver the same under pressure, such as 500 pounds per square inch (psi) to a manifold pipe unit 9 of a system flow line 3 secured immediately beneath the hopper unit 6 as a part of the pumping apparatus. The pumping assemblies 8 and 8′ are individually and similarly constructed and uniquely mounted, for individual and separately controlled movement, to the supporting frame 4 as more fully described herein. The structure of pump assembly 8 is therefore described in detail, with the corresponding elements of the pump assembly 8′ identified and referred to by corresponding prime numbers.

Generally, the pumping assemblies 8 and 8 are selectively coupled to the hopper 6 and the discharge flow line 3 through the manifold pipe unit 9 shown as a siamese or Y-shaped pipe assembly terminating in a common discharge pipe connection 9*a* to the input end of the transfer line 3 immediately adjacent the pumping apparatus 1. The hopper 6 is provided with a pair of side-by-side openings having projecting coupling or hopper discharge pipes 10 and 10′ for selective supply of concrete to the pump assemblies 8 and 8′. Referring particularly to FIGS. 3 and 4, pump assembly 8 is shown as a piston-cylinder construction adapted to be driven from a high pressure hydraulic supply unit 11 mounted on the frame 4 immediately adjacent the forward end of the chassis. The hydraulic supply unit 11 is diagrammatically illustrated as a suitable engine driven assembly mounted to the forward portion of the frame 4. The weight of several elements and including the hopper assembly 6, the pumping assemblies 8, 8′ and the hydraulic power supply unit 11 are properly distributed to create a balanced load or weight within the pumping apparatus. The apparatus 1 is thus a stable assembly both in the transport position and in the operating position.

The pump assembly 8 includes concrete pump unit or section 12 and an actuating power section 13, the latter of which is suitably connected to hydraulic supply unit 11 for operating of power section 13. The pumping assembly 8 is pivotally mounted for selectively aligning of the pump unit 12 with the hopper discharge openings 10 and alternatively with a line inlet pipe 14 of the manifold pipe unit 9. Pump assembly 8′ is similarly pivotally mounted and positioned between hopper opening 10′ and a line inlet pipe 15 of the Y-shaped pipe unit 9. Thus, the pipes 14 and 15, of course, merge into a suitable common pipe 16 connected to the common connection 9*a* and thereby to the inlet end of the line 3.

Referring again to pump assembly 8, a rotating valve plate 18 is secured to the pump section 12 and pivots therewith. The valve plate 18 extends to the opposite side of the cylinder opening and includes a flat front wall which functions to close the hopper opening 10 or the inlet pipe 14 when either of the latter is not aligned with the pump section 12.

In the illustrated embodiment of the invention, a hydraulic actuator 19 is coupled to the rotating plate 18. The actuator is connected to hydraulic power source 11 and operated to selectively pivot the total assembly including the rotating valve plate 18 and the pump assembly 8 to appropriately and alternatively align the pump unit 12 with the opening 10 and the inlet pipe 14.

A floating valve plate assembly or unit 20 is located between the rotating valve plate 18 and the hopper opening 10 and inlet pipe 14 to seal the connection and prevent leakage of concrete during the pumping operation.

The pump assembly 8′ is similarly mounted to the opposite side of the frame 4 with the actuator 19′ selectively aligning the pump unit 12′ with the hopper opening 10′ and the inlet pipe 15.

The hydraulic actuator units 13, 13' and 19, 19' are operated in appropriate timed and sequential relation to provide for the alternate charging and discharging of the pumping sections 12 and 12' in alternate relationship to establish and provide a continuous flow of concrete from the hopper 6 and through the pumping apparatus 1 into the line 3, without any delay or hesitation in the outward flow. This, of course, eliminates the undesirable problem associated with overcoming static friction and the inertia forces associated with a nonflowing semi-fluid concrete within the flow line 3.

Generally the sequence includes three different distinct stages. Referring for example to FIGS. 3 and 4, pump assembly 8 is shown in a discharging position for discharging of the semi-fluid concrete into the inlet pipe 14 and through the Y-shaped pipe unit 9 to the flow line 3. At this period, the pumping section 12' of assembly 8' is aligned with the hopper opening 10' and is being charged with the semi-fluid concrete. Prior to complete discharge and emptying of pump section 12, the pump section 12' is completely filled. The actuator 19' is then actuated and rotates the pump assembly 8' from the charging position to the discharging position, aligned with the inlet pipe 15 of the Y-shaped pipe unit 9. This alignment is completed prior to the complete cycle of the pumping section 12, and pump section 12' is actuated prior to the complete discharge of the section 12 such that concrete simultaneously flows through both branches to line 3. Thus, the two units 8 and 8' are operated simultaneously to create continuous flow of concrete, with section 12' continuing to discharge after the section 12 has been completely discharged. When pump assembly 8' is discharging, pump assembly 8 is pivoted from the discharge position illustrated in FIG. 3 to the charging position with the section 12 aligned with the hopper opening 10. The third state is thus created with pump assembly 8' solely discharging into the pipe 15 of unit 9 and line 3 with its hopper inlet opening 10' closed by the valve plate 18', and the pump assembly 8 charging, with its inlet pipe 14 of unit 9 closed by valve plate 18. During the movement of the pump assemblies 8 and 8', rotating valve plates 18 and 18' are engaged with the floating valve plate units 2 and 20' to maintain a positive and reliable seal at the respective connection such that there is no loss of the concrete from the system.

More particularly in the illustrated embodiment of the invention, the mobile assembly may include a mounting framework 21 secured to the front end of the frame 4. Framework 21 may include a front plate and suitable side plates to create a suitable rigid support for the various components such as the actuators 19 and 19', pivot supports for the adjacent end of assemblies 8 and 8' and the like. Hopper 6 is shown as a conventional open-top housing mounted in front of the assembly 21 and thus adjacent the assemblies 8 and 8'. In the preferred embodiment of the present invention a positive discharge of the concrete 7 from hopper 6 is provided. In the illustrated structure, an auger 22 is rotatably mounted within the hopper 6 and coupled to a suitable hydraulic drive motor or other suitable drive 23. Motor 23 is operative to continuously rotate the auger 22 for positive forcing of the concrete 7 toward the discharge hopper openings 10 and 10'. The hopper 6 thus includes a front vertical wall 24 with the hopper openings 10 and 10' located within such wall for selective coupling to the respective pump assemblies 8 and 8'. Auger 22 provides a positive feed of the concrete to the assemblies 8 and 8' as well as for providing for a continuous mixing and remixing of the concrete mix.

As most clearly shown in FIGS. 3, 4 and 7, pump assembly 8 is mounted by a pivot shaft 25 which is fixedly supported to the opposite ends upon the frame 4 in any suitable manner. In the illustrated embodiment of the invention, a support journal 26 is secured to the front end of frame 4 for supporting the one end of the shaft 25. A back pivot block or journal 27 is similarly secured to the frame 4 to support the back end of the pivot shaft 25. The pump section 12 and the actuating section 13 are interconnected to each other and to central pivot support plates 28 connected by a common pivot sleeve or pivot journal **28*a* secured between the plates and bolted to shaft 25 to pivot therewith and pivotally mounted on the shaft 25**.

The section 13 includes a support plate 29 which projects therefrom and is attached to and pivots with the shaft 25. The back end of shaft 25 is affixed to the valve plate 18 as at 30 which in turn is coupled to the actuator 19. Thus, operation of actuator 19 operates to pivot the plate 18 and attached shaft 25, which correspondingly pivots the pump assembly 8.

The pump assembly positioning actuator 19 is also a piston-cylinder unit including a cylinder 31 pivotally mounted, as by pivot pin 32 to a cross-brace assembly **32*a* forming a part of the front wall assembly 21. The piston rod 33, connected within cylinder 31 to a piston, not shown, projects downwardly with the outer end pivotally interconnected by a suitable pivot bracket to valve plate 18 as at 34. The hydraulic cylinder 31 is provided with suitable hydraulic connectors 35 and 36 at the opposite end, and connected to the motor-driven supply unit 11. The control selectively supplies hydraulic fluid to the opposite ends of the cylinder 31 for selective reciprocation of the piston rod 33 and thereby pivots plate 18, attached shaft 25 and attached pump assembly 8**.

The pump operator section 13 of pump assembly 8 is similarly a piston-cylinder unit having a cylinder 37 rigidly affixed to the back pivot plate 39 and to the one plate. A piston rod 38 projects outwardly through the central pivot assembly **28–28*a* and is coupled to operate pump section 12. Pump section 12 is also a piston-cylinder unit having a cylinder 39 rigidly mounted to the second plate 28 at the outer end and in valve plate 18 at the opposite end. The cylinder 39 is open and aligned with a corresponding opening 40 in the valve plate 18. A piston 41 is secured to the extended end of actuator rod 38 and reciprocally mounted within the cylinder 39. Piston 41 is thus positioned by the actuation of the operation section 13 to selectively withdraw and force the concrete 7 into and from cylinder 39**.

The piston-cylinder units for the actuation section 13 and the section 12 may be of any known or desired construction and in actual practice can readily be provided by those skilled in the art. Consequently, no further detailed description or illustration is given.

In the illustrated embodiment of the invention, the position of the pump assemblies 8 and 8' are continuously monitored to permit appropriate timed positioning and operation thereof. As shown most clearly in FIG. 1, a limit switch actuating rod 42 is releasably secured by a bracket **42*a* to the piston rod 38. The rod 42 extends rearwardly through the pivot plate 28. A switch actuator 43 is secured to the outer end of rod 42. The actuator 43 is a block-like member having oppositely inclined end surfaces 44 and 45. Suitable control or limit switches are secured in the path of the actuator 43. In the illustrated embodiment of the invention, three switches 46, 47 and 48 are secured in longitudinally spaced relation to supporting frame 4 in the path of the actuator 43. Switches 46–48 are each shown as well-known limit switch units having a pivotally mounted operating arm 49 which extends downwardly into the path of the actuator 43. Switches 46 and 48 are located to the opposite ends of the operating cylinder 37 and thus indicate the full retraction and extension of the piston operator and a corresponding positioning of the concrete pump piston 41 between its two limits. Interlock limit switch 47 is located immediately adjacent to the full discharge end switch 48 to provide an interlock signal within the system and create a timed overlap with the opposite valve or pump assembly 8'. The switches 46–48 are connected in any suitable control circuit to establish charging and discharging of the concrete 7 from the hopper 6 to assemblies 8 and from assemblies 8 through the Y-pipe unit 9 to line 3**.

Figure 9:
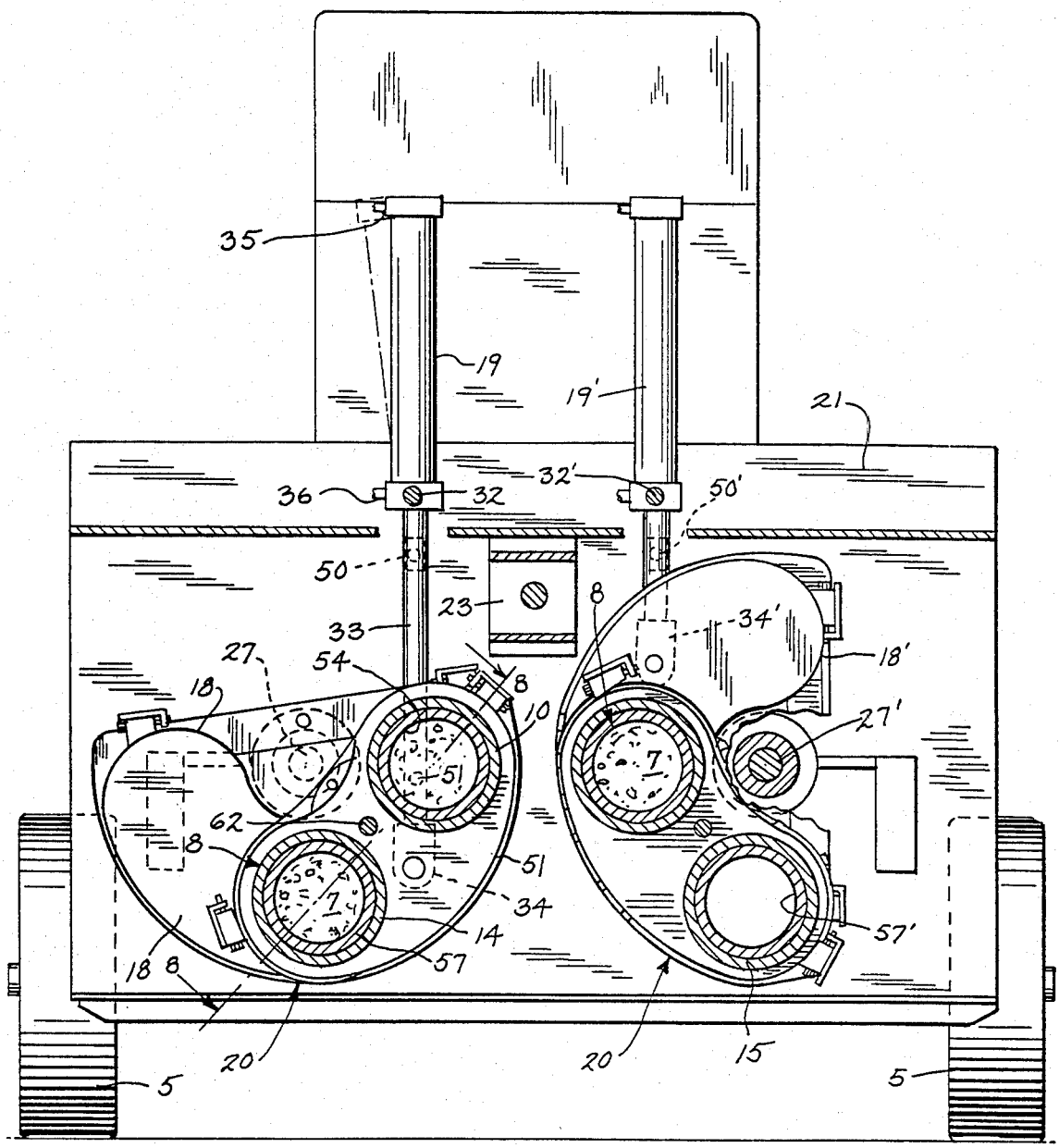
FIG. 9 is a sectional view taken generally on line 9—9 of FIG. 3.

In addition, the rotated position of the assemblies 8 and 8' is monitored by retract and extend limit switches 50 and 51 mounted adjacent the corresponding vertical positioning cylinder unit 19 and 19'. Thus, the piston rods 33 are provided with a suitable actuator 51*a* which moves into engagement with the retract limit switch 50 with the unit 19 fully retracted and with the extended limit switch 51 with the unit 19 fully extended. As shown in FIG. 9, the valve plate 18 is correspondingly positioned to align the pump assembly 8 with the hopper opening 10 in the retracted position and with the inlet Y-pipe unit in the extended position.

As previously noted, the floating valve plate assembly 20 is located between the rotating plate 18 and the opening 10 and inlet pipe 14 to maintain a positive sealed connection during the positioning of the pumping assembly 8 between the charging and discharging positions.

As most clearly shown in FIGS. 4, 7–10, the floating valve plate assembly 20 includes a generally arc-shaped floating valve plate 52 located adjacent to, and in sliding abutting engagement with, the rotating valve plate 18 of pump section 13. The floating valve plate 51 has a pair of openings 53 and 53*a* angularly spaced in accordance with the hopper opening 10 and the inlet pipe 14 of Y-pipe unit 9. A plate coupling conduit or pipe 54 is secured within the opening 53 and extends therefrom into the hopper or outlet pipe 10. The projecting end of the pipe 54 is formed with a notched construction with a resilient sealing gasket 55 having a complementing coupling notched portion secured thereto. The gasket 55 is an annular rubber-like member having a cylindrical outer wall slidably engaging the inner surface of the discharge pipe 10. The gasket 55 projects from pipe 54 and the innermost interior wall is tapered as at 56 to provide a generally feathered edge. Thus, as the concrete 7 is forced out through the opening pipe 54, the pressurized concrete also forces the gasket 55 radially outwardly into firm sealing engagement with the side wall of pipe 54 to firmly seal the discharge opening.

A similar coupling pipe 57 is fixed within discharge pipe 53*a* in alignment with the inlet pipe 14. The pipe 57 thus extends outwardly and includes a corresponding sliding seal 58 within the pipe 14 of the Y-shaped pipe unit 9.

A hydraulic cylinder unit 60 is mounted in fixed relation to the hopper 6 and supporting frame structure 4 as by bracket 61. A piston rod 62 projects outwardly and is interconnected by connecting stud 63 to the floating valve plate 52. The hydraulic cylinder unit 60 is connected to the output of the engine driven source 11 through a suitable pressure regulating valve 64 to maintain a constant outward pressure on the floating plate 52 and thereby maintains the plate in firm and sliding engagement with the rotating valve plate 18.

The continuous pivoting of the pump assembly 8 will eventually create some surface abrasion, and may eventually result in a significant breakdown of the sealing effectiveness. As illustrated, the rotating valve plate 18 and the floating valve plate 52 are similarly formed with replaceable face plate. Referring particularly to FIG. 8, a face plate 65 is releasably mounted and forms the front opposed sliding face of plate 18. Similarly, in FIGS. 8 and 10, plate 52 has a face plate 66 releasably mounted and forms the front opposed sliding face of plate 65. The releasable plates 65 and 66 may thus be formed with hardened and relatively highly finished surfaces to produce an effective seal against outward flow of the concrete, including the water content. The plate may, of course, be formed of other suitable materials and finishes. Thus, one or both plates may be formed of relatively soft metal such that any abrasion or wear may occur on such plate or plates, with appropriate replacement when necessary. In the event of any wear within the sliding seal structure, the outer wear plates can be readily replaced. The wear plates 65 and 66 have openings which are in precise alignment with the opening in the plates 18 and 52. The plates 65 and 66 are similarly releasably clamped in place, and the clamp structure for the floating valve plate unit is shown in FIG. 10 and described for purposes of explanation.

Plate 52 includes a pivot pin 70 located above and between the hopper and transfer inlet openings 10 and 14. A series of guide pins 71 are located to the opposite side of plate 52. Similar clamps 72 and 73 are located to the opposite sides of the wear plate 66. Referring to clamp 72, an L-shaped support 74 is secured to the plate 52 opening toward the edge of plate 66. A wedge 75 is located between the clamp support 74 and the edge of plate 66. A positioning bolt 76 is threaded through wedge 75 and rotatably fixed in the cross leg of the support 74. Rotation of the bolt 76 thus forces the wedge 75 between the fixed support 74 and the plate 66 to pivot the plate. The opposing clamps 72 and 73 thus permit accurate positioning of the wear plate 66 into precise alignment with openings 10 and 14.

The wear plates 65 and 66 are readily accessible by swinging of the hopper support unit to the open position as shown in FIG. 6. Thus, the hopper and inlet unit 9 are mounted to a swinging door 78 which is pivotally attached along one side of the apparatus to the back support structure 32, as at 79.

Further, a resilient seal ring, not shown, may be provided circircling the floating valve plate for sliding engagement with the rotating valve plate. The normal high speed operation, particularly the charging stroke, creates substantial pressure differential, which may eventually cause air leakage because of plate wear with use. Although this would not seal between the plate openings, the undesired air leakage would be.

The apparatus is preferably constructed with the four wheels 5 mounted for road engaging positioning as in FIG. 1 or raised to permit lowering of the apparatus into pumping position with the framework 4 fixedly supported on the ground by suitable rigid support legs 80 adjacent each wheel 5 as shown for example in FIG.

2. In the illustrated embodiment of the invention, each wheel axle is secured to the outer end of a pivot arm 81, the opposite end of which is pivotally supported within the adjacent leg 80. The leg 80 is shown as a channel member having a flat bottom support wall 82. The leg 80 is welded as at 83, or otherwise rigidly affixed to the side frame 4 and depends therefrom. The wheel pivot arm 81 is pivotally mounted on a suitable pivot pin 84 within the leg 80. A tubular air bag unit 85 has one end bolted or otherwise fixed within the channel-shaped leg 80 with an air valve 86 for selectively supplying and removing of air from the bag 85. A piston 87 projects into the bag 85 in the manner of a rolling diaphragm. The piston 87 is interconnected to the wheel arm 81 by a suitable triangular shaped bracket 88 such that the wheel load tends to force the piston 87 into the air bag unit 85. The bag 85 is blown up to force the piston 87 outwardly causing the wheel arm 81 to pivot and move the wheel 5 downwardly into ground engagement. The air bag 85 of course, also functions as a shock absorber during the transport mode of operation. Conversely, when the air is bled off, the weight of the apparatus pivots or collapses the pivot arm 81 and wheel 5 upwardly, with the piston 87 moving into the bag structure as more clearly shown in FIG. 2. The result is the lowering of the rigid support leg 80 downwardly into ground engagement. Obviously any other suitable desired design can be employed but that illustrated has been found to be a highly satisfactorily reliable support.

The pump positioning means and the pump operators may be controlled by any suitable control circuit having means to rather precisely establish the positioning of the pump assemblies and creating the appropriate speed of charging and discharging to establish the continuous flow into and through line 3. The quantity of concrete delivered is controlled by controlling of the speed of the pump assemblies 8 and 8'. In the illustrated embodiment of the invention, a plurality of pump valve units 90, 91, 92, as shown diagrammatically in FIG. 3 couple the engine-driven pump assembly to an output line 93. Valves 90 through 92 are solenoid actuated valve means to control the flow and volume of hydraulic fluid supplied to the several valve and power means.

Figure 11:
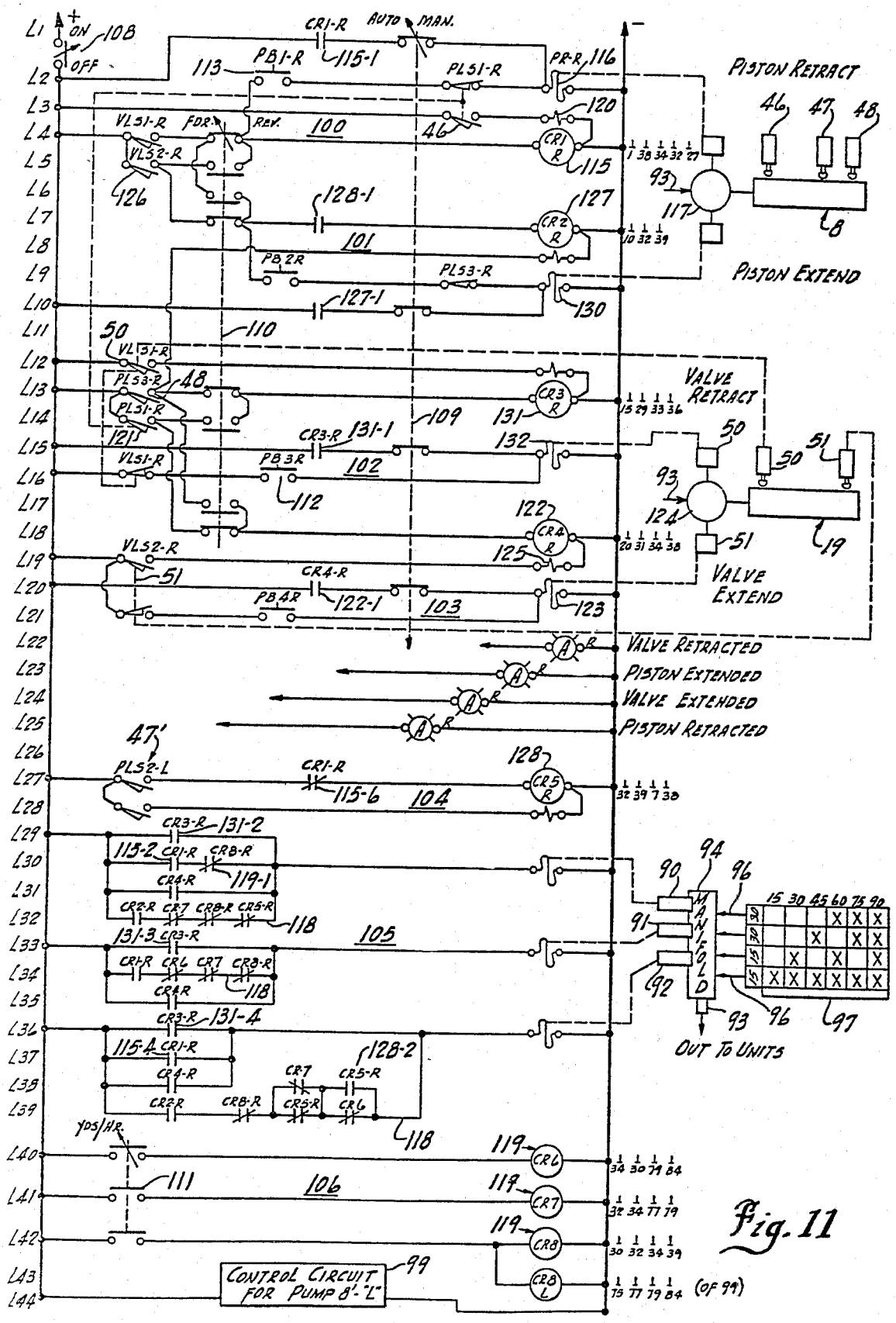
FIG. 11 is a schematic circuit diagram illustrating one operable control system.

Referring particularly to FIGS. 1, 3, and 11, the hydraulic system is shown including a manifold 94 connected to output line 93 which is connected to supply the pump actuating sections 13 and 13' as well as to the vertical positioning cylinder units 19 and 19'. As the pump section 13 and the positioning unit 19 never operate simultaneously, the manifold 94 can be coupled to the units for proper timed operation thereof. The manifold 94 is coupled in parallel to the pump output through a direct minimum flow connection 96 as well as the three solenoid valves 90 through 92. The output of the valve means may provide the same or distinctly different flows. In one embodiment, the output of the pump unit included a direct or minimum fifteen gallons per minute output, a similar valved output and two valved thirty gallons per minute outputs. The total output is controlled by appropriate action of the solenoids, as shown in the logic diagram 97 in FIG. 11. The logic diagram 97 is shown in a conventional matrix with the different total output in gallons per minute identified at the upper ends of the diagram columns and the input flows in the several rows. The matrix conditions are satisfied by appropriate identified energizing of the solenoids valves 90 through 92, as shown by the "X" identified intersections. In the illustrated embodiment of the invention, flow increments of 15 gallons per minute were used including flows of 15, 30, 45, 60, 75 and 90 gallons per minute, as shown. The solenoids, as more fully developed hereinafter, are selectively energized, in part, in response to the setting of the speed selector which is connected to the control circuit, shown for example in FIG. 11. In addition, each of the valves 90 through 92 is preferably combined with a relatively small pilot valve 98 which permits accurate control and tuning of the flow rate for the particular valve. This is desirable to allow accurate control of the discharge rate of pump assemblies 8 and 8' to maintain a continuous outward flow of the concrete into the main flow line 3. A suitable operating circuit employed in connection with apparatus such as shown in FIGS. 1 through 10 is shown in FIG. 11, with the positioning and operating means as well as the hydraulic flow control system diagrammatically illustrated.

The pump assemblies 8 and 8' are individually and separately controlled and positioned to permit precise discharging of concrete with a timed overlap to maintain a constant and continuous flow through line 3. Thus the one pumping cylinder 39 is charging at a greater rate than the opposite cylinder 39' is discharging, and is positioned into the discharge position prior to complete discharge of discharging cylinder. At a predetermined point of the discharging cylinder 39, the two cylinders 39 and 39' operate at half speed until the partially discharged cylinder is fully discharged, at which time the empty cylinder is cut off and recycled for charging while the other partially discharged cylinder transfer to full speed discharge operation, thereby maintaining the desired continuous flow of concrete into and through flow line 3. When the partially discharged second cylinder moves to the terminal portion, the opposite cylinder has again been charged and positioned for discharge, and the simultaneous discharge is again established with subsequent cycles continuing.

Further, the system may of course be reversed with the cylinders charged in the above described discharge position and discharging of the concrete to the hopper 6. Referring particularly to FIG. 11, the valve positioning units 19 includes a fourway valve unit connected to the line 93 for selectively supplying hydraulic fluid to the operating cylinder for retraction and extension of the positioning unit 19. The fourway valve is electromagnetically operated as presently described. The operating section 13 of pump assembly 8 is similarly connected to the supply by a fourway valve.

Referring to FIG. 11, an across-the-line circuit diagram is shown for the pump assembly 8 and only certain interlocking to the pump assembly 8'. The coupling to the positioning valve unit 19 and to the power section 13 of pump assembly 8 are also diagrammatically shown. The circuit for operating of the pump cylinder 8' is a complete duplicate and is thus shown as block 99. The circuit for assembly 8 includes the branch lines connected between electrical power lines connected to a suitable power source such as a twenty-four volt battery, not shown, and shown as parallel horizontal lines which are numbered L1 through L43 for reference purposes. The pump assembly circuit generally includes a piston retract section 100 including lines L1 through L5; a piston extend section 101 including lines L6 through L10; a valve retract section 102 including lines L12 through L17 and a valve extend section 103 including lines L18 through L21. In addition, an overlap interlock section 104 is shown at lines L27 and L28 which provide for the alternate actuation and interlocking of the circuits for the pump assembly 8 and the pump assembly 8' during the discharge portion of each cycle. In addition to the illustrated embodiment of the invention, the solenoid operating branch circuit 105 for solenoids 90 through 92 is shown including lines L29 through L39 inclusive and the speed selector section 106 including lines L40 through L43 inclusive. The circuit shown is constructed for automatic continuous system operation as well as a limited manual control such as for set up and the like. Referring to FIG. 1, a simplified illustration of control panel 107 is shown with a plurality of actuating controls shown as suitable push button and rotary selector switches. The control panel thus includes four rotary switches including a main on-off switch 108, an automatic-manual selection switch 109, a forward-reverse switch 110, and a multiple quantity or speed control switch shown having settings of 20 35, 50 and 75 yards of concrete per hour. The control switches 108–111 are shown as rotary type switches. Push-bottom control switches are also shown for manual operation of the pump assemblies 8 and 8', in either a forward or a reverse direction. The switches include first pair of discharge control buttons 112 for controlling the valve positioning unit 19 and a second pair of discharge control buttons 113 for reversely actuating the operator section 13 of the pump assembly 8.

In FIG. 11, the switches 108 through 110 are set for automatic operation and with a forward drive for transferring concrete from the hopper 6 into the transfer line 3. The automatic-manual switch connections as well as the interrelated push bottom switches will be readily understood by those skilled in the art and a detailed description thereof is not given.

In the circuit, various conventional and identifying legends have been used. The several limit switches in addition to being identified in accordance with the previous numbers are also identified with identifying legends associating them with the valve positioning unit 19 by the letter "V" and with the power operator sections 13 for the pump assemblies by the letter "P" as well as the usual conventional identification employed in industry. The letter "R" and "L" are added respectively for identifying the assembly relating to the actuator 8 and 8'. The power cylinder solenoids and the valve positioning solenoids are similarly identified with an associated additional letter "R" for retract and "E" for extend. The relays and other components are identified by conventional symbols and legends. The numbers along the right side of the drawing indicate the cross line position of contacts associated with the relay on the same branch line. A vertical line above the number indicates a normally open contact while an inverted "T" indicates a normally closed contact.

The circuit of FIG. 11 will be described with reference to a pumping cycle of operation, and assuming cylinder 39 of the pump assembly 8 is in the charge position aligned with the opening 10 of hopper 6 and pump assembly 8' is discharging into the Y-section inlet pipe unit 9. In this position the limit switch 50 (VLS1R) is closed as a result of a full retraction or raising of the valve cylinder unit 19, and a relay 115 (CR1) in line L4 is energized. The several contacts of relay 115 includes a set of contacts 115-1 in line L1 providing power to the retraction solenoid 116 which operates the fourway valve unit 117 to power section 13 to supply fluid to retract the cylinder 39 of pump assembly 8. The associated piston pump 41 in cylinder 39 retracts correspondingly and concrete is forced from hopper 6 into the cylinder 39. The speed at which the assembly 8 moves is determined by the position of the speed or quantity selector switch 111 and the selection circuit section 105 which includes a separate branch line for each solenoid 90 through 92. Relay 115 also controls contacts 115-2 in lines L30 to the solenoid 90, contacts 115-3 in line L34 to the solenoid 91, and contacts 115-4 at line 37 to the solenoid 92. The relay contacts in line L37 for solenoid 92 provide direct energization and solenoid 92 is energized during each charge to insure provision of a minimum supply of 30 gallons per minute. Depending upon the setting of speed selectors switch 111, solenoids 90 and/or 91 are energized for increasing the flow and retraction or charging rate. Each of the solenoid branch circuits is constructed to establish the desired flow logic in accordance with the state of the system, and in particular the quantity of concrete to be pumped whether the pump assembly is being rotated between its alternate positions, or is being charged or discharged. In particular, each of the solenoid branches includes a speed discharge control line 118 shown at line L32 for solenoid 90, at line L34 for solenoid 91 and line L39 for solenoid 92. The separate lines 118 includes the discharge interlock contact from the operating sections as hereinafter described and contacts from the speed selector switch circuit 106. The selector switch 111 has a plurality of contacts, one in each of the selected lines L40-42 and selectively energizes the several relays in each position to establish certain combinations of the hydraulic pump volumes at different stages of the pumping cycle. Speed selector switch 111 is thus shown as having three sets of contacts or switches, each connected in series with a related relay 119. The relays 119 control contacts in the several branch circuits 118 for controlling of the charging and discharging rates. Thus, if the speed selection relay 119 (CR8) in line L42 is not energized, the associated contacts 119-1 in line L30 are closed, solenoid 90 is also energized, thereby providing at least a 60 gallons per minute. Similarly, if all of contacts in the line L34 remain closed, solenoid 91 is also energized and establishes a maximum flow charge rate, namely 90 gallons per minute. Thus, the cylinder 39 of pump assembly 8 charges at a selected rate. When the cylinder 39 of pump assembly 8 has been fully retracted to its extreme position, thereby indicating full charging thereof, the limit switch 46 (PLS1R) is actuated. Switch 46 is connected in line L3 to operate an unlatch coil 120 for relay 115 (CR1) and when closed relay 115 drops out. The limit switch 46 is a multiple contact unit and includes a second switch unit 121 connected in line L14, which, when closed, energizes a valve extend relay 122 (CR4) in line L18. Relay 122 closes contact in the several lines as indicated and in particular establishes power to the valve extend coil or solenoid 123 (VER) in line L20. The coil is coupled to the fourway valve 124 of cylinder positioning unit 19 which now reverses the hydraulic supply causing the unit 19 to extend, pivoting of the pump assembly 8 to the discharge position in alignment with the inlet pipe 14 of the Y-pipe unit 9. When the pump cylinder reaches this position, the associated actuator operates the switch 51 (VLS 2R), connected in line L19. This actuates an unlatch coil 125 for the relay 122 (CR4), and a second set of contacts or switch 126 of limit switch 51 connected in line L5 arms that line to provide power to the power extend relay 127 (CR2) in line L7. Normally open relay contacts 128-1 of interlock relay 128 (CR5-R) are connected in series in line L7.

The relay 128 (CR5-R) is an interlock relay forming a part of interlock circuit 104 at lines L27-L28. Relay 128 is connected in series with normally closed contacts 115-6 of the piston retract relay 115 (CR1-R), and with the limit switch 47' (PLS2L) for the opposite pump assembly 8'. Relay 128 (CR5R) cannot be energized to provide extend power whenever the retract relay 115 is energized. As the power actuating unit 13' of then discharging pump assembly 8' moves forwardly, the associated actuator 43' moves into engagement with the anticipitory switch 47' in the same manner as shown in FIG. 3 for assembly 8. When limit switch 47' (PLS2-L) closes, relay 128 (CR5-R) is energized to close contacts in lines L7 and energize the extend relay 127 (CR2-R), which closes contacts 127-1 in line L10 to provide power to the piston extend solenoid 130 (PE-R). The fourway valve 117 is reset by solenoid 130 to supply hydraulic fluid to the power operator section 13 of pump assembly 8 to discharge pump assembly 8. The pump assembly 8 and 8' then both discharge concrete into the Y-section.

Relay 128 (CR5) also has contacts L28-2 connected in the speed control circuit 105 and in particular at line L32 for solenoid 90 and line L39 for solenoid 92, and function to reduce the speed of both pump assemblies 8 and 8' to half normal selected speed for the remainder of the discharge stroke of the pump assembly 8 thereby maintaining the total output constant. When the opposite pump assembly 8' has completed the discharge stroke, the associated end limit switch 48' (PLS3L) is closed, to terminate its discharge cycle, arm the circuit to positioning unit 19' in its control circuit and de-energize relay 128 (CR5) to shift the pump assembly 8 into a full speed operation. Pump assembly 8 then continues to discharge concrete to maintain the desired continuous flow into line 3. The opposite pump assembly 8' being fully discharged is moved to the charge position to operate switch 50' of valve positioning unit 19' which establishes a valve retract circuit, the same as shown in lines L12 through L16 of FIG. 11 wherein a valve retract relay 131 (CR3) is connected in series with limit switch 50 (PLS3-R) for pivoting of pump assembly 8 to the charging position. Thus, relay 131 (CR3R) is connected at line L13 in series with full discharge switch 48 of pump assembly 8. Relay 131 actuates contacts 131-1 in the fourway valve solenoid line L15 for energizing of the valve retract solenoid 132 which is coupled to reset the fourway valve 124 to actuate the valve positioning unit 19 to retract and thereby pivot the pumping assembly 8. Relay 131 (CR3) also controls contacts 131-2 in line L29 to solenoid 90 and contacts 131-3 in line L33 to solenoid 91 and contacts 131-4 line L36 to solenoid 92. All solenoids 90-92 are energized, establishing maximum flow and thereby maximum speed for the pump assembly 8 during this pivoting motion.

In the above described sequence the pump assembly 8 thus continues to discharge at full speed during which period the duplicate circuit 102 for the opposite pump assembly 8' is operative to pivot the pump assembly 8' to its charging position. The system has thus completed one cycle and is in the proper position, and does function to rapidly charge pump assembly 8' by operation of a circuit in unit 99 corresponding to that shown in lines L1 through L4, and beginning a similar cycle as that described above which began with charging of pump assembly 8 while pump assembly 8' was discharging. The cyclically charging and discharging of the pump assemblies 8 and 8' with the timed overlapping discharge continues automatically and repeatedly with the alternate positioning the pump assemblies and particularly cylinders 39 and 39' thereof until the system is turned off as by the opening of the main on-off switch 108 to remove power from the system.

The illustrated system also includes a distinct safety interlock in that neither of the pump assemblies 8 or 8' can be actuated to move in either direction unless the positioning valve is in one of the extreme positions to align the corresponding pumping assembly with the hopper 6 or with the inlet line 14 for discharge to line 3. This interlock is maintained for both manual and automatic control. However, the fourway valves may be provided with additonal manual override such as to permit movement of the pump assemblies directly.

A practical application may be encountered in the building of a high rise hotel structure wherein concrete or the like may be pumpted to heights in excess of 200 and 300 feet. In such a system, a 5 inch flow line would be employed, with the pump operating at output pressures on the order of 500 psi and generally within a range of 300 to 800 psi. This will provide a range of 40 to 78 yards of concrete per hour to the deposite side. Internal pulsating pressures on the order double the normal pressure may be encountered within the flow line if any significant change in the flow rate occurs with the reaction forces tending to create very significant movement of the flow line. The present invention when applied to such an application establishing an essential flow of concrete and maintains an essentially still line, without any significant adverse effect created. The size of the line, the pressures employed and the like of course varies with particularl concrete pumping specifications such as the length of the flow line, the concrete mix and the like. In practically all instances, similar considerations and problems are presented in varying degrees and all of which are minimized if not completely eliminated by employing the independently operable pumping units with the interrelated control to thereby establish the desired smooth constant flow characteristic in accordance with the basic teaching and structure of this invention. The present invention can be and has been employed without the use of any reaction blocks without adverse movement of the flow line.

Although the just described illustrated embodiment provides an improved apparatus for concrete pumping and the like, the discharge rate is limited by the required capability of moving the pump assemblies with proper timing. In the first embodiment, the discharged pump unit must be quickly moved to the charging position, rapidly charged and repositioned to the discharging position to complete such cycle in a period in less than the discharge period of the then discharging pump unit. When the discharge rate is low and the discharge period is quite long, the system can be conveniently operated with reasonable hydraulic operating power. However, as the concrete discharge rate requirement increases the power required to move the apparatus and fully charge each pump assembly may prevent practical implementation. Thus, the power system may be excessively costly, and even if provided, the rapid movement may create such vibration of or in the apparatus as to prevent the desired system operation. Further, the rapid charging may tend to create a small but discernible air cushion within the charging pump cyclinder. During the discharge cycle, this may result in a transient type pressure drop and a less than optimum flow.

Figure 12:
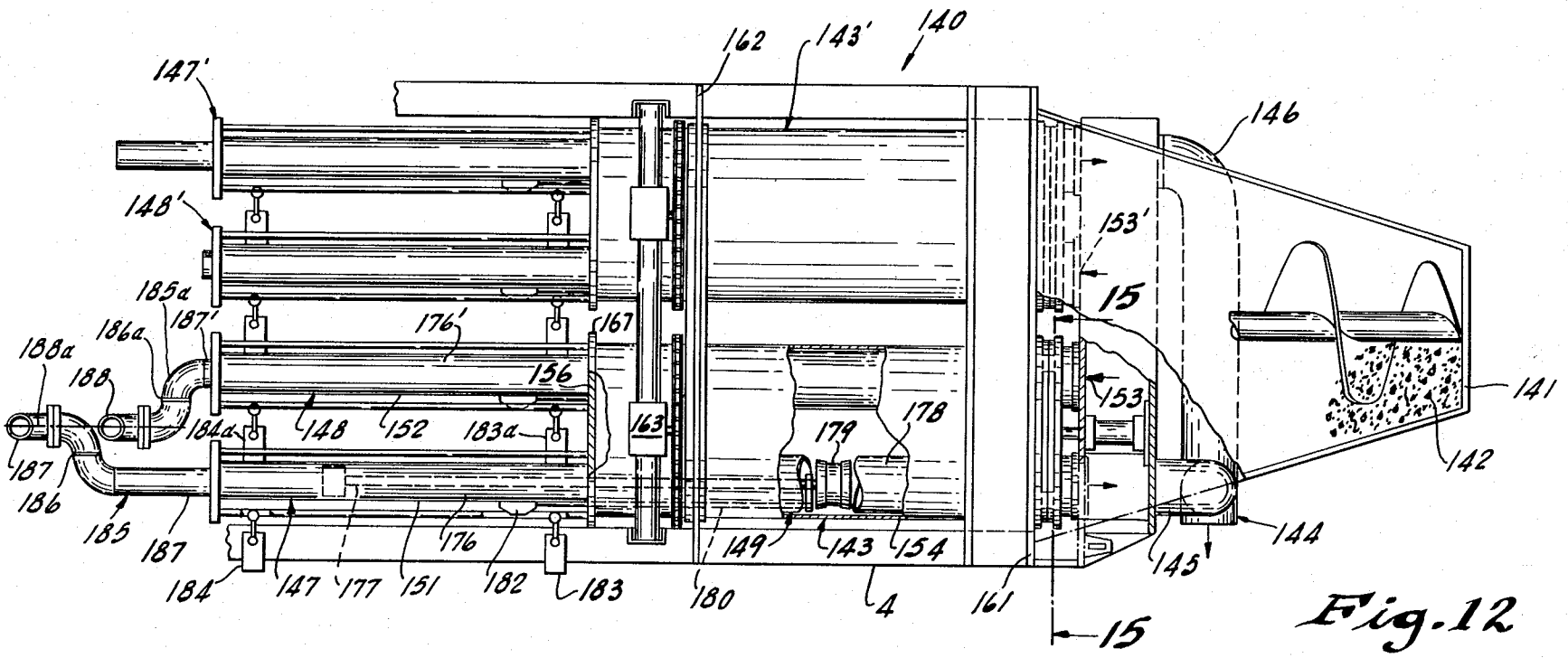
FIG. 12 is a fragmentary plan view of an alternate embodiment of the present invention.
Figure 15:
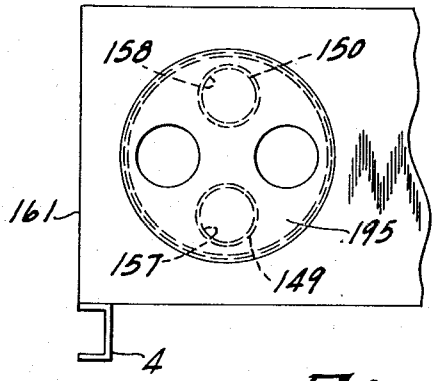
FIG. 15 is a fragmentary section taken generally on line 15—15 of FIG. 12 and illustrating an intermediate position of the pumping apparatus.
Figure 13:
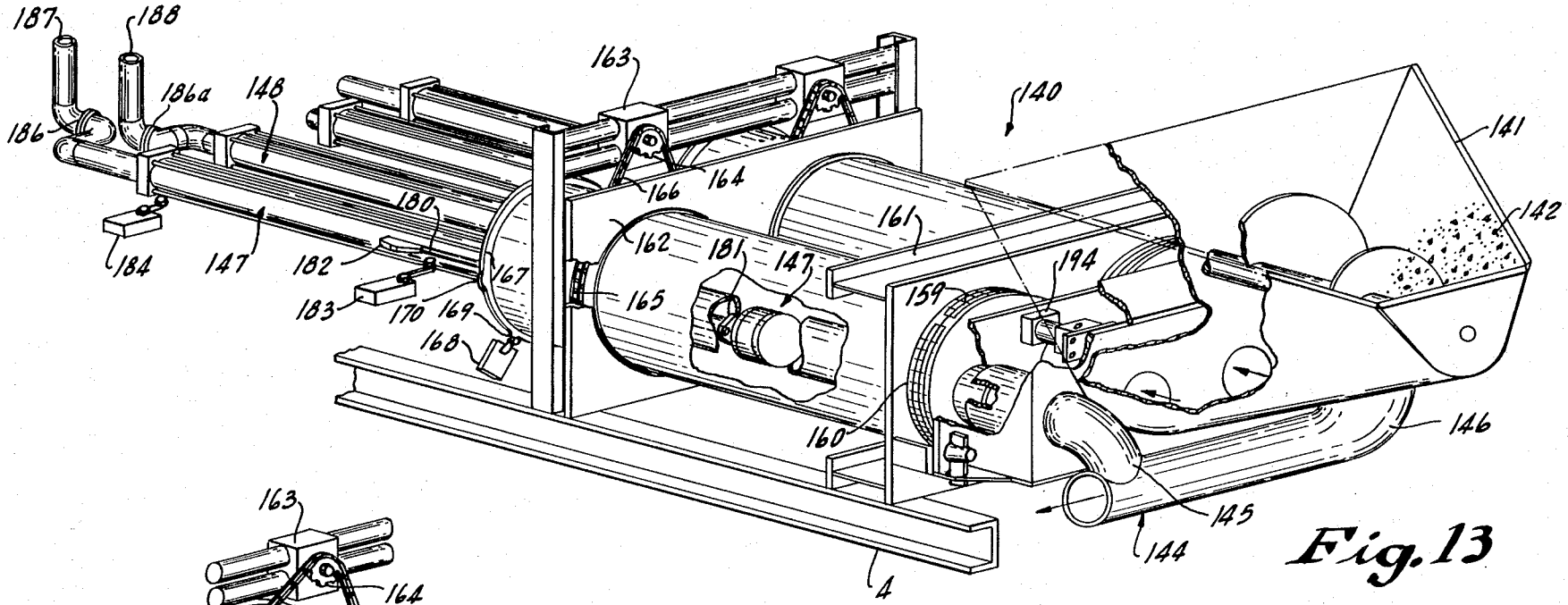
FIG. 13 is a pictorial view of the structure shown in FIG. 12.
Figure 14:
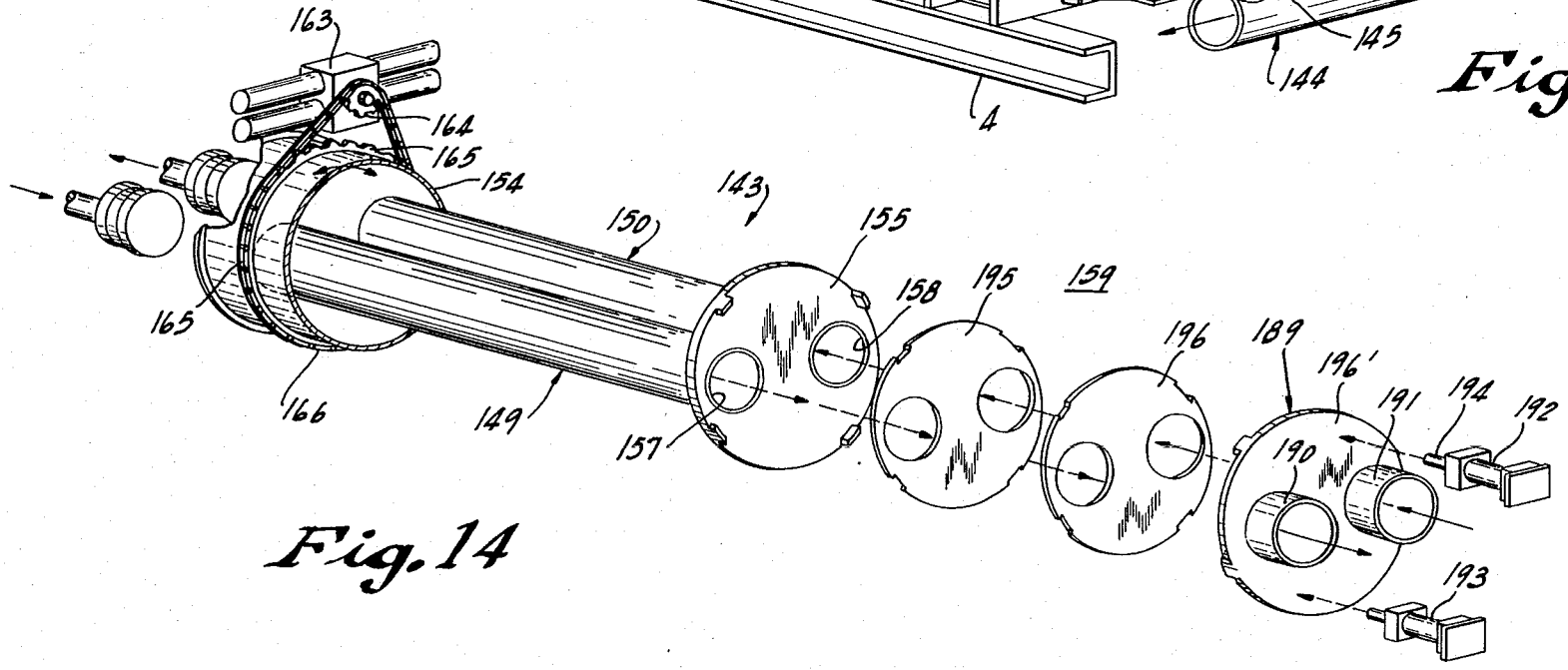
FIG. 14 is a fragmentary exploded view of one section of the pumping apparatus shown in FIGS. 12 and 13.

Referring particularly to FIGS. 12–14 an alternate mobile concrete pumping apparatus 140 is illustrated which avoids the timing and power limitations of the first embodiment. The apparatus 140 includes an open topped concrete hopper 141 having a powered auger means for discharging the semi-fluid concrete 142 as a continuous source or supply to first and second modified concrete pump assemblies 143 and 143' mounted immediately forwardly of and coupled to or discharge openings of the hopper. The pump assemblies 143 and 143' are also operable to remove the concrete 142 and deliver the same under pressure to an on-site supply pipe or line unit 144 secured immediately beneath the hopper unit 141 as a part of the pumping apparatus. The inlet pipe unit 144 in the alternate embodiment is shown as a common manifold type unit having separate branch lines 145 and 146 to each pump assembly 143 and 143'. The second embodiment may be formed as a mobile unit with a supporting framework, hopper structure and hydraulic supply according to that of the first embodiment. Pump assemblies 143 and 143' are mounted for individual and separately controlled movement to the supporting frame generally in accordance with the concept used in the first embodiment. The pumping assemblies 143 and 143' of the second embodiment are individually and similarly constructed with an improved operating structure which particularly improves the power and timing specifications. The second embodiment is therefore shown and described as necessary to clearly explain the novel pumping system, with reference to the common component of the first embodiment identified by similar numbers for simplicity and convenience of explanation.

The structure of pump assemblies 143 and 143' are shown the same. The structure of pump assembly 143 is therefore presently described in detail, with the corresponding elements of the pump assembly 143' identified and referred to by corresponding primed numbers.

Referring particularly to FIGS. 12 and 14, pump assembly 143 is shown including first and second piston-cylinder pump units or structures 147 and 148, each of which is adapted to be driven from the high pressure hydraulic supply unit 11 mounted on the frame immediately adjacent the forward end of the chassis.

Each concrete pump unit or structure 147 and 148 is similarly constructed and includes a corresponding concrete pump section 149 and 150 and an actuating power section 151 and 152, respectively. The pumping assembly 143 is pivotally mounted for alternately and selectively positioning with a first position in which the pump unit 148 is aligned with a hopper opening 153 and the second pump unit 147 with inlet pipe 145 of the transfer pipe unit 144, and in a second position in which pump unit 148 is aligned with the input pipe 145 and the pump unit 147 is aligned with the hopper opening 153. Pump assembly 143' similarly includes first and second pump units 147' and 148' which are similarly pivotally mounted and positioned between hopper opening 153' and an inlet pipe 146 of the manifold pipe unit 144.

Referring again to pump assembly 143 and particularly FIGS. 12 and 14, the pump unit 147 and 148 are secured to and within a cylindrical support housing or enclosure 154 having pump supporting end walls including a rotating valve plate 155 secured to the forward ends of the pump sections 149–150 and a rotating support plate 156, shown in FIG. 12, secured to the aft end thereof. The valve plate 155 is a circular member which encompasses the hopper opening 153 and the inlet pipe 145 for pump assembly 143. The valve plate 155 includes openings 157 and 158 to the respective pump units and particularly pumping sections 149 and 150. The valve plate 155 forms the pumping cylinder part of a modified floating valve plate assembly or unit 159 located between the pumping assembly 143 and the hopper opening 153 and inlet pipe 145 to seal the connection and prevent leakage of concrete during the pumping operation, similar to the first embodiment.

In the illustrated embodiment of the invention, the total assembly 143 including the rotating valve plate 155 oscillates through 180 degrees to appropriately and alternatively align the pump units 147 and 148 with the hopper opening 153 and the inlet pipe 145.

The cylinder housing 154 is rotatably mounted at the hopper end in a suitably bearing 160 in a bearing and support plate 161 which forms a part of the supporting framework. The housing 154 is similarly rotatably mounted in forwardly spaced relation to the plate 161 in a second bearing and support plate 162 of the supporting framework. The housing 154 and therefore the two pump units 147-148 are rotated by a hydraulic positioning means which includes a hydraulic motor 163 mounted above the housing and forwardly of the support plate 161 in a suitable support members **163*a* suitably secured to the framework. A chain and gear drive includes a small driven gear 164 secured to the output shaft of motor 163 and a large annular gear 165 secured to the housing periphery, with the gears coupled by a drive chain 166. In the illustrated embodiment, the supporting housing 154 is oscillated through 180° to alternately establish the alternate first and second positions of the pump units 147-148 of pump assembly 143 with respect to the hopper opening 153 and the inlet pipe line 145**.

The angular position of the pump assembly 143 is monitored by a peripherial cam 167 secured to the outer end of the enclosure or housing 154. A switch unit 168 includes a cam follower 169 riding on the cam 167. The cam 167 includes suitable switch acting ramp portions 170 for actuating a pair of switches 171-172 to terminate the pump oscillation with the assembly 143 in either the first or second positions.

As shown in FIGS. 12 and 14, the pump operating sections 151 and 152 for of the pump units 147 and 148 of pump assembly 143 are also similar piston-cylinder units. Thus referring to pump unit 147, a power cylinder 176 is rigidly affixed to the back support plate 156 and extends outwardly in a cantilivered support. A piston rod 177 projects through the support plate and is coupled to operate pump section or unit 149. Pump section 149 is also a piston-cylinder unit having a cylinder 178 rigidly mounted within the enclosure 154 and particularly to plate 156 at the outer end and valve plate 155 at the opposite or hopper end. The cylinder 178 is open at the hopper end and mounted within the corresponding opening 157 in the valve plate 155 to form a smooth common end plane. A concrete pumping piston 179 is secured to the extended end of power operating rod 177 and reciprocally mounted within the cyliner 178. Piston 179 is thus positioned by the actuation of the operating section 151 to selectively draw and force the concrete into and from cylinder 178, as in the first embodiment.

In the second embodiment of the invention, the pumping position of the pump assemblies 143 and 143' is continuously monitored to permit appropriate timed positioning and operation thereof. In the second embodiment, as shown in FIGS. 12 and 13 a limit switch actuating rod 180 is shown releasably secured by a bracket 181 to the piston rod 177 of each pump unit 147 and 148 of assembly 143. The rod 180 extends rearwardly with a switch actuator 182 secured to its outer end. Actuator 182 is a block-like member having oppositely inclined end surfaces for operating a pair of limit switches 183 and 184 which are secured in the path of the actuator. In the illustrated embodiment of the invention, the two limit switches 183 and 184 are located in longitudinally spaced relation to the supporting frame to monitor and indicate the full retraction and extension of the piston operator and a corresponding positioning of the concrete pump piston 179 of pump section 149. The pump unit 148 includes similar switches **183*a* and 184*a* to monitor the full retraction and extension of the concrete pump unit or section 150. The switches 183-184 and 183*a*-184*a* are connected in a suitable control circuit to establish charging and discharging of the concrete from the hopper to pumping units 149 and 150 of assembly 143 and from such assemblies into flow line inlet manifold 144**.

Piston-cylinder units forming pump operating sections 151 and 152 always operate in a directly opposite direction and may therefore be cross connected to the suitable pressurized hydraulic supply. Thus, when the concrete pumping cylinder unit 149 is discharging, the cylinder unit 150 is charging, and vice versa. In the illustrated embodiment each power operating cylinder 176 and 176' includes supply connectors 185 and **185*a* secured to the outer free or head end of the cantilevered cylinder. The connectors 185 and 185*a* are shaped pipe members having the one end fixed to the cylinder and the opposite outer end secured by a swivel coupling 186 and 186*a* to one of two hydraulic supply lines 187 and 188 for receiving and returning of hydraulic fluid to the pressurized supply. The supply lines 187 and 188 are suitably mounted within the mobile framework. The connectors, with the swivel coupling 186 thus permit the oscillator motion of the pump units 147 and 148 without interruption of the hydraulic supply connections. As noted previously, the pump units 149 and 150 each include a separate set of position monitoring switches 183-184 and 183*a*-184*a*. The separate switches are provided even though the series flow connection might appear to provide automatic opposite cycling and permit monitoring only within one of the units. However, any leakage of hydraulic within the system may result in some offset or deviation from the desired precise opposite movement of the two units, with resulting improper and incomplete charging or discharging of one unit. With the separate monitoring of each unit, the switches can be readily connected in a suitably control circuit with the switches interlocked such as to insure the complete stroke of each unit. Thus, each unit must reach its extreme end position before the crossover signal for such unit is actuated to rotate to assembly while the timed overlapped operation of the assemblies 143 and 143' are controlled by the proper signal between the two assemblies. Further, although shown with the mechanically push rod actuated switch means, any other type of position monitoring control means can of course be used and may be desirable. For example, if increased concrete pumping pressure is needed or desired, the operator unit 147 and the concrete pump unit 149 may be of the same cylinder diameter, rather than with a smaller diameter cylinder unit as shown. The provision of the external rod 177 is then more difficult. Other means will be readily provided, such as a mechanical, hydraulic or electrical sensor or other type of position sensors built into the heads of the operator units. The pump assembly 143 is oscillated to alternately align the concrete pumping units 149 and 150** with the hopper opening to charge that cylinder and with the flow line inlet pipe to discharge the opposite cylinder.

As most clearly shown in FIG. 14 the floating valve plate assembly 159 of the second embodiment includes a circular floating valve plate 189 located adjacent to, and in sliding abutting engagement with the rotating valve plate 155 of pump unit 149. The floating valve plate 189 has a pair of coupling pipe units 190 and 191 spaced in accordance with the hopper opening 153 and the inlet pipe 145 and coupled with a suitable seal structure into the hopper opening and into outlet pipe as in the first embodiment.

A pair of hydraulic cylinder units 192 and 193 are mounted in fixed relation to the hopper and supporting frame structure as by suitable bracket. The cylinder units 192-193 include piston rods 194 interconnected to the floating valve plate 189 and connected by a suitable pressure regulating valve, not shown, to maintain constant outward pressure on the floating plate as in the first embodiment. The valve plates are thus held in firm and sliding engagement to essentially eliminate leakage at the rotating junction.

The oscillating of the pump assemblies 143 and 143' may eventually create some surface abrasion, and may eventually result in a significant breakdown of the sealing effectiveness. The rotating valve plate 155 and the floating valve plate 156 are therefore preferably also formed with replaceable face plates 195 and 196. The face plates 195 and 196 may be simple flat, round plates which are releasably mounted to form the front opposed sliding face of the valve plate 155 and the floating plate 189. Plates 195 and 196 are prevented from rotating to maintain the openings aligned with the valve plate openings. The releasable plates 195 and 196 may be formed with hardened and relatively highly finished surfaces to produce an effective seal against outward flow of the concrete, including the water content. The plate may, of course, be formed of other suitable materials and finishes as described with respect to the prior embodiment.

The pump assembly 143' is similarly mounted to the opposite side of the frame 4 with the paired pump structures 147' and 148' separately connected in alternate fashion to the separate hopper opening 153' and inlet pipe 146 of manifold unit 144.

The pump assemblies 143 and 143' are operated in appropriate timed and sequential relation to provide for the alternate charging and discharging of the pumping sections in each pump assembly, and the discharging from the pump assemblies in alternate relationship to establish and provide a continuous flow of concrete from the hopper and through the pumping apparatus into the manifold unit 144 and therefore the common discharge line without delay or hesitation in the outward flow even at high rates of concrete flow.

Generally the sequence includes three different distinct stages. Referring for example, to FIGS. 12 and 13, pump assembly 143 is shown with pump unit 149 in a discharging position for discharging of the semi-fluid concrete into the inlet pipe 145 from pump unit and through the manifold pipe unit 144 to the flow line. Simultaneously, pump unit 150 is charging at the same rate as the pump unit is discharging. At this period, the pump section 149' of assembly 143' has been charged with the semi-fluid concrete while pump section 150' of assembly 143' is completely discharged. The hydraulic rotating motor for assembly 143' is then actuated and rotates the pump assembly 143' from the last discharging position to the now charging position in which pump unit 150' is aligned with hopper pipe of the hopper and the charged pump unit 149' is moved into alignment with the inlet pipe. This alignment is readily completed prior to the complete cycle stage of the pumping action of the section 149 of the now discharging assembly 143. The pump section 149' is actuated prior to the complete discharge of the section 149 such that concrete simultaneously flows through both branches to manifold unit 144.

The additional period available for moving of a charged pump unit of assembly 143' into position for discharging also permits further improvement in the conditioning of the last charged pump unit 150'. In charging of the pump unit 150' the associated piston moved outwardly creating a suction force on the incoming concrete from the hopper 141. At the end of the stroke, a very slight void may be created within the just fully charged cylinder of pump unit 150'. If such a cushion exists, a pressure drop may be created during the discharge of such cylinder. Although generally such a pressure change may be rather minor, the characteristic of such an assembly is not the optimum constant output pressurization desired for optimum concrete pumping. The significance of the pumping pressure becomes more significant if unusually high pumping rates are required. Although the pressure characteristic may be generally insignificant at a rate of 50 yards per hour, such a pressure characteristic may be of greater significance at rates of 100 yards per hour.

During the rotation, the circular valve plates 155 rotate relative to plate 189 and at the 90° position the opening 157-158 are offset from the hopper opening 153 and the inlet pipe 145. The offset valve plates therefore serve to close the hopper opening and the inlet pipe and to the fully charged cylinder pump unit 149'. By applying pressure to the operating sections 151' for charged cylinder 149', the pumping piston 179' is urged outwardly to establish precompression of the concrete in the charged cylinder. The fully charged cylinder then moves to the discharge position, and directly and positively transmit the pressurized concrete. Thus, the two units 143 and 143' may be operated simultaneously to create continuous flow of concrete.

When pump unit 149 of pump assembly 143 is discharging the alternate pump unit 150 is of course charging, as noted previously. When pump unit 149 of pump assembly 143 has fully discharged, the pump assembly 143 is pivoted from the position illustrated in FIG. 13 to the alternate position, passing through the intermediate precompression position for the fully charged cylinder. During each oscillation movement of the pump assemblies 143 and 143', rotating valve plates 155 and 155' are engaged with the floating valve plate units 159 and 159' to maintain a positive and reliable seal at the respective connection such that there is no loss of concrete from the system.

In this second embodiment, the separate paired pumping assemblies 143 and 143' eliminate the necessity of the rapid charging of a concrete pump section 149, 150, 149' and 150'. The charging cylinder is therefore filled or charged from the hopper at the same rate as discharging of the paired cylinder to the inlet pipe. Thus, the pump assemblies 143 and 143' are positioned to alternately discharge into the common manifold 144. As the one pump assembly 143, for example, is moving to discharge one concrete pumping unit 149 and charge its paired concrete pumping unit 150, the opposite pump assembly 143' has completed its cycle and is rotating to reverse its concrete pumping units 149' and 150 alignment. Thus, as opposite pump assembly 143' had completed its cycle of discharging, one pump unit 149, for example, the opposite pump unit 150' of such assembly 143' becomes fully charged. Now, during the discharging cycle of the pump assembly 143, the opposite pump assembly 143 is properly rotated to reverse its position and align the charged pump unit 150' with its inlet pipe 145'.

In the present embodiment, the precompression may be provided to positively eliminate any void and ensure the discharge of the concrete from the pump unit upon alignment with the manifold unit 144.

The present invention thus provides a means for pumping concrete and other semifluid materials at the required pumping pressures. These pressures may be in the range of 500 PSI and may of course be substantially higher, with momentary pressure in the thousands of PSI and may involve very substantial masses of such materials as previously noted. Such an environment of course presents unique problem, particularly when high pumping rates are required or desired, with respect to maintaining proper pressure on the discharging material and positive continuity in the supply of the material to the pump apparatus and from such apparatus to the discharging line. The present invention provides a significant improvement in such pumping apparatus and in particular in creating and maintaining a more optimum pumping characteristic, with a long life apparatus which can be produced and maintained with practical and commercially available supplies and techniques.

Various modifications and changes can of course be made therein within the significant concept of the essentially independent positioning and controlling the charging and discharging of a plurality of pump means. This novel approach permits the proper charging and discharging and creation of a true essentially continuous overlap in the outflow to maintain the desired flow characteristic, particularly useful in the high pressure pumping of concrete and the like, while avoiding complex mechanical coupling and valving means.

We claim:

1. A continuous flow pumping system for high pressure pumping a semi-fluid material with a substantially constant and uniform pressure discharge, comprising (a) a supply means having a power discharge means for forcing of the material from said supply means, said supply means having at least two spaced outlet opening means, (b) a manifold means having at least two spaced inlet means connected to a common output means for establishing an output flow, (c) a first pump means having first and second pump units separately operable to receive said material and to discharge said material, (1) first support means mounting said first pump means adjacent said supply means and said manifold means with said first and second pump units aligned one each with a first of said outlet opening means and with a first of said manifold inlet means, (2) said first support means including first transfer means for simultaneous movement of said first and second pump units to reverse said alignment with said first outlet opening means and said first manifold inlet means, (d) a second pump means having third and fourth pump units separately operable to receive said material and to discharge said material, and (1) second support means mounting said second pump means adjacent said supply means and manifold means with said third and fourth pump units aligned one each with a second of said supply outlet opening means and with a second of said manifold inlet means, (2) said second support means including second transfer means for simultaneous movement of said third and fourth pump units to reverse said alignment with said second outlet opening means and said second manifold inlet means, and (e) operating means for operating said first and second pump means and said first and second transfer means and including means to move one of said pump means with the other of said pump means held in position, and establishing alternating pumping cycles, each of which has three distinct pumping stages and with one cycle including a first stage in which said first pump means is positioned and discharging the first pump unit and charging the second pump unit with the second pump means completing the discharge of the third pump unit and the charging of the fourth unit and a second stage in which said first pump means continues to operate in the mode of the first stage and said second pump means is being transferred to reverse the position of the third and fourth pump units, and a third stage in which said first pump means continues to operate in the mode of the first stage and said second pump means is actuated to charge and discharge the third and fourth pump units and with the alternate second pumping cycle corresponding to said one cycle with said first and second pump means operating in the mode of the opposite pump means in said one cycle.

2. The continuous flow pumping system of claim 1 wherein each of said pump units includes a pumping cylinder having an open end to receive said material and to discharge said material and a pumping piston slidably mounted in said cylinder, (a) said first and second support means each includes a separate rotatable bracket secured to the corresponding pump units and mounted in bearing means for rotating said pump means about an axis parallel to and located between said cylinders of the corresponding pump units, (b) each of said first and second pump means including power operating piston-cylinder units secured to said first and second support means and connected to one each to each of said pumping pistons, and (c) hydraulic source means connected to the piston-cylinder units for each of said pump means for operating said respective pump units, with the pump unit of each pump means operating in the opposite direction from the other pump unit of said pump means.

3. The pumping system of claim 2 wherein said power operating piston-cylinder units each having a single input-output connector selectively connected to the opposite sides of said hydraulic source means, said first and second transfer means each including an axis of rotation for rotating said corresponding pump units, and each connector including a swivel means permitting rotation of said piston-cylinder units about said axis of said corresponding transfer means.

4. The continuous flow pumping system of claim 2 wherein said rotatably bracket in a cylindrical housing having said pump units mounted within the housing and with the open ends mounted within a first valve plate secured in the one end of the housing, a rotating drive means connected to oscillate said housing through 180 degrees for simultaneous movement of said pump units to reverse said alignment of said pumping cylinders with said outlet opening means and said manifold inlet means, an opposing valve plate secured to said outlet openings and slidably engaging said first valve plate, said simultaneous movement of said pump units to reverse said alignment with said outlet opening means and said manifold inlet means establishing an intermediate position in said pump units with said end openings closed, means for pressurizing said first and second pump units in said closed position.

5. The continuous flow pumping system of claim 1 wherein each of said pump units includes a pump cylinder and pumping piston to receive said material and to discharge said material and a power piston-cylinder to move said pumping piston, (a) said first and said second support means each includes a rotatable bracket connected to support said pump means with said pump cylinders in side-by-side alignment with the open ends in a common plane, (b) said first and said second transfer means each includes means for rotating said bracket to reverse said alignment of said pump cylinder with said corresponding outlet opening means and manifold inlet means.

6. The flow pumping system of claim 5 including means for operating said first and second pump means and means for monitoring the position of the means for operating said first and second pump means, and the rotated position of said brackets.

7. The pumping system of claim 2 having separate valve plate means mounted between each pump means and the supply outlet opening means and manifold inlet means and including sealing means movable with said support means and slidably engaging relatively fixed means secured to the supply means to maintain an essentially closed connection therebetween during the movement of said support means.

8. The pumping system of claim 7 including hydraulic power means to urge the relatively fixed means into sealing engagement with said sealing means.

9. The pumping system of claim 1 wherein each pumping means includes a pair of hydraulic supply lines, a pair of swivel connectors secured to the supply lines and to a port of the pump units, a crossover line means between said pump units whereby the pump units are operated in opposite directions, said swivel connectors having a turning axis coincident with the turning axis of the corresponding pump means.

* * * * *